US011237510B2

(12) United States Patent
Kudo et al.

(10) Patent No.: US 11,237,510 B2
(45) Date of Patent: Feb. 1, 2022

(54) IMAGE FORMING APPARATUS

(71) Applicant: CANON KABUSHIKI KAISHA, Tokyo (JP)

(72) Inventors: Yoshiki Kudo, Mishima (JP); Akihiko Uchiyama, Mishima (JP); Hiroshi Kita, Mishima (JP); Masaki Shimomura, Suntou-gun (JP); Takahiro Nakase, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/066,662

(22) Filed: Oct. 9, 2020

(65) Prior Publication Data

US 2021/0096494 A1 Apr. 1, 2021

Related U.S. Application Data

(63) Continuation of application No. 16/749,442, filed on Jan. 22, 2020, now Pat. No. 10,838,342.

(30) Foreign Application Priority Data

Jan. 23, 2019 (JP) ..... JP2019-009779

(51) Int. Cl.
*G03G 15/00* (2006.01)
*G03G 15/01* (2006.01)

(52) U.S. Cl.
CPC ..... *G03G 15/5058* (2013.01); *G03G 15/0131* (2013.01); *G03G 15/0194* (2013.01); *G03G 15/5041* (2013.01); *G03G 2215/00042* (2013.01); *G03G 2215/00059* (2013.01); *G03G 2215/00063* (2013.01)

(58) Field of Classification Search
None
See application file for complete search history.

(56) References Cited

U.S. PATENT DOCUMENTS

2015/0063843 A1 3/2015 Saito
2017/0242386 A1* 8/2017 Hirata ..... G03G 15/556

FOREIGN PATENT DOCUMENTS

JP 2013-137577 A 7/2013

* cited by examiner

*Primary Examiner* — Jas A Sanghera
(74) *Attorney, Agent, or Firm* — Venable LLP

(57) ABSTRACT

An image forming apparatus, configured to operate in first and second modes of which color gamut is different from each other, includes an exposure unit configured to expose a photosensitive drum; a developing roller configured to form a toner image; a detection unit configured to detect density of the toner image transferred to an intermediate transfer member; and a controller configured to adjust the density based on a value of input image data. A dithering process for the controller's controlling of the exposure unit is different depending on whether the operation is in the first mode or the second mode, and in at least a part of the input image data, the density of the toner image formed by the dithering process in the first mode is higher than the density of the toner image formed by the dithering process in the second mode.

7 Claims, 23 Drawing Sheets

FIG.10A 521 522

| DRUM LIFETIME[%] | 100 | | | | | | 80 | | | | | |
|---|---|---|---|---|---|---|---|---|---|---|---|---|
| DEVELOPING LIFETIME[%] / ΔE(NORMAL) | 100 | 80 | 60 | 40 | 20 | 0 | 100 | 80 | 60 | 40 | 20 | 0 |
| 0 | 0 | 0 | 0 | 0 | 0 | 0 | 0 | 0 | 0 | 0 | 0 | 0 |
| 10 | -5 | -5 | -6 | -7 | -8 | -8 | -6 | -6 | -7 | -7 | -8 | -9 |
| 20 | -5 | -5 | -6 | -7 | -7 | -7 | -6 | -6 | -7 | -7 | -8 | -9 |
| 30 | -3 | -4 | -4 | -4 | -5 | -5 | -5 | -5 | -6 | -7 | -8 | -8 |
| 40 | -1 | -1 | -2 | -2 | -2 | -3 | -4 | -4 | -5 | -6 | -7 | -7 |
| 50 | 1 | 0 | 0 | 0 | -1 | -1 | -2 | -2 | -3 | -3 | -4 | -4 |
| 60 | 2 | 1 | 1 | 0 | 0 | 0 | 0 | 0 | -1 | -1 | -2 | -3 |
| 70 | 4 | 4 | 3 | 2 | 2 | 1 | 3 | 2 | 2 | 2 | 1 | 1 |
| 80 | 6 | 6 | 5 | 4 | 3 | 3 | 6 | 5 | 5 | 4 | 3 | 3 |
| 90 | 1 | 1 | 1 | 0 | 0 | 0 | 1 | 1 | 1 | 0 | 0 | 0 |
| 100 | 0 | 0 | 0 | 0 | 0 | 0 | 0 | 0 | 0 | 0 | 0 | 0 |
| 110 | 0 | 0 | 0 | 0 | 0 | 0 | 0 | 0 | 0 | 0 | 0 | 0 |
| 120 | 0 | 0 | 0 | 0 | 0 | 0 | 0 | 0 | 0 | 0 | 0 | 0 |

521a 521b 522a 522b

⋮

*FIG. 10B*

| DRUM LIFETIME[%] | 100 | | 80 | | 100 | 80 | 90 |
|---|---|---|---|---|---|---|---|
| DEVELOPING LIFETIME[%] / ΔE(NORMAL) | 100 | 80 | 100 | 80 | 90 | 90 | 90 |
| 0 | 0 | 0 | 0 | 0 | 0 | 0 | 0 |
| 10 | -5 | -5 | -6 | -6 | -5 | -6 | -6 |
| 20 | -5 | -5 | -6 | -6 | -5 | -6 | -6 |
| 30 | -3 | -4 | -5 | -5 | -4 | -5 | -5 |
| 40 | -1 | -1 | -4 | -4 | -1 | -4 | -3 |
| 50 | 1 | 0 | -2 | -2 | 1 | -2 | -1 |
| 60 | 2 | 1 | 0 | 0 | 2 | 0 | 1 |
| 70 | 4 | 4 | 3 | 2 | 4 | 3 | 4 |
| 80 | 6 | 6 | 6 | 5 | 6 | 6 | 6 |
| 90 | 1 | 1 | 1 | 1 | 1 | 1 | 1 |
| 100 | 0 | 0 | 0 | 0 | 0 | 0 | 0 |
| 110 | 0 | 0 | 0 | 0 | 0 | 0 | 0 |
| 120 | 0 | 0 | 0 | 0 | 0 | 0 | 0 |
| | 521a | 521b | 522a | 522b | 521c | 522c | 523 |
| | STEP 1 | | | | STEP 2 | | STEP 3 |

IMAGE FORMING APPARATUS

BACKGROUND OF THE INVENTION

Field of the Invention

The present invention relates to an image forming apparatus which includes a plurality of image forming modes.

Description of the Related Art

Color gamut is an image quality index used with an image forming apparatus. The color gamut of an image forming apparatus is a color reproduction range which the image forming apparatus can output, and as the color gamut widens, the color reproduction range widens, which means that the image forming apparatus has advanced features. A possible method of expanding the color gamut is adding thick developers of four-colors (YMCK) to the regular developers of YMCK, or increasing the amount of developer on the recording material. Japanese Patent Application Publication No. 2013-137577 discloses an image forming apparatus for performing quality printing in various print modes.

A configuration having other image forming modes to reduce process speed, besides the standard image forming mode, has been proposed. "Other image forming modes" include a thick paper mode. For such a configuration having a plurality of image forming modes, it is proposed to calculate the density in other image forming modes by arithmetic processing from the measured density information in the standard image forming mode. Thereby tinge can be adjusted in the other image forming modes without any additional downtime.

However, the above-mentioned configuration having a plurality of image forming modes has the following problems. Specifically input image data, which is measured as density 0 in the standard image forming mode, may be input image data which is measured as density 0 as well in another image forming mode, or may be input image data which is detected as a density that is not 0. Therefore, in the case of the configuration having a plurality of image forming modes, as mentioned above, the density of the low density portion is calculated by extrapolation based on the result of calculating the density of the high density portion.

FIG. 20 is a diagram depicting an image of the method of calculating the density of a low density portion from the result of calculating the density of a high density portion by extrapolation. The ordinate indicates a density OD and the abscissa indicates a value of image data in hexadecimal representation.

Herein an image data value I1, in which the measured density becomes a value close to a boundary 700, which is now assumed to be a boundary of a certain density range, will be considered. It is assumed that when the image data value is I1, an actually measured value of the density of an image formed in a normal print mode is D1. This is plotted as the measurement result 701*a*. Then based on this measurement result 701*a*, a calculation point 701*b*, which is the result of calculating the density in the wide color gamut print mode, is calculated.

In the same manner, it is assumed that when the image data value is $I_2$, an actually measured value of the density of the formed image is $D_2$, and the actual measurement result 702*a* is plotted. Then based on this actual measurement result 702*a*, a calculation point 702*b* is calculated.

Then based on the calculation points 701*b* and 702*b*, an approximation line 703*a* is calculated. Using this approximation line 703*a* and the value of the image data corresponding to a low density portion LD, the calculation points 704, 705, 706 and 707 are calculated.

However, when the calculation points 701*b* and 702*b* are determined from the measurement results 701*a* and 702*a*, an error in a range indicated by the upward and downward arrows from each measurement result is included. Because of this error, the approximation line can change in the 703*b* to 703*c* range. As a result of this change of the approximation line, each of the calculation points 704, 705, 706 and 707 may include an error in the range indicated by the upward and downward arrows from each calculation result. This error is larger compared with an error that is generated when a density is generated in a wide color gamut print mode based on the density measurement result of the low density portion LD in the normal print mode. This error further increases as the image data becomes smaller, and the image data departs more from the calculation point 701*b* of calculating the approximation line.

SUMMARY OF THE INVENTION

According to an aspect of the present invention, an image forming apparatus that operates in a first mode in which an image is formed in a first color gamut, and a second mode in which an image is formed in a second color gamut which is different from the first color gamut, includes:

a photosensitive drum;

an exposure unit that forms an electrostatic latent image by exposing the photosensitive drum;

a developing roller that forms a toner image by developing the electrostatic latent image which is formed using a toner on the photosensitive drum by the exposure unit;

an intermediate transfer member to which the toner image formed on the photosensitive drum by the developing roller is transferred;

a density detection unit that detects the density of the toner image transferred to the intermediate transfer member; and a controller that adjusts the density of the toner image on the basis of a value of input image data which is inputted, wherein a dithering process performed when the controller controls the exposure unit is different depending on whether the image forming apparatus is operating in the first mode or the second mode, and in at least a part of the input image data in which the density of an image to be formed is on a low density region side, the density of the toner image which is formed by the dithering process in the first mode is higher than the density of the toner image which is formed by the dithering process in the second mode.

Further features of the present invention will become apparent from the following description of exemplary embodiments (with reference to the attached drawings).

BRIEF DESCRIPTION OF THE DRAWINGS

FIG. 10A and FIG. 10B are wide color gamut print mode chromaticity calculation tables according to Embodiment 1;

DESCRIPTION OF THE EMBODIMENTS

Preferred embodiments of the present invention will now be described with reference to the drawings. Dimensions, materials, shapes, relative positions and the like of the components described below may be appropriately changed depending on the configuration and various conditions of the apparatus to which the invention is applied. Therefore, the following description is not intended to limit the scope of the present invention.

Embodiment 1

General Configuration of Image Forming Apparatus

Figure 1:
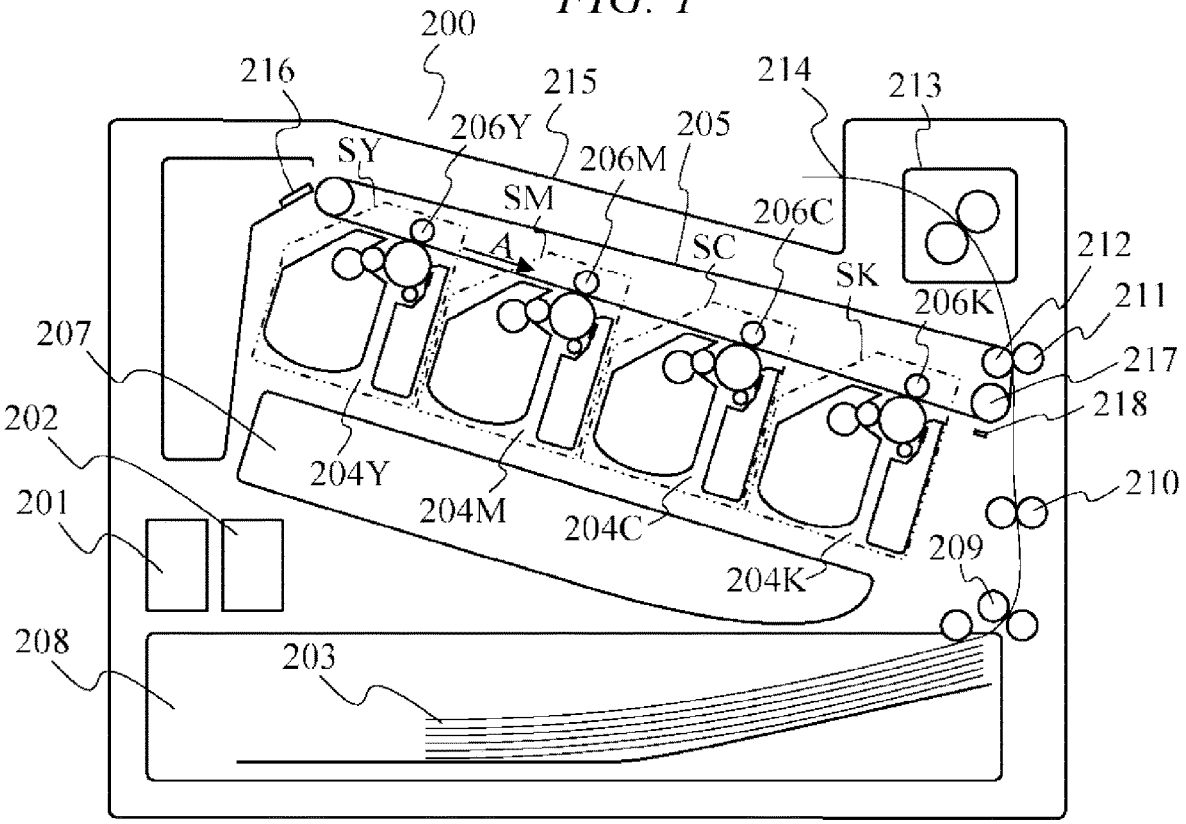
FIG. 1 is a schematic diagram depicting a configuration of an image forming apparatus according to Embodiment 1.

FIG. 1 is a schematic diagram depicting the configuration of an image forming apparatus 200 of Embodiment 1. The image forming apparatus 200 is an in-line type full color laser printer using the intermediate transfer system. The image forming apparatus 200 forms a full color image on a recording material 203 according to image information that is inputted from a host PC (not illustrated) to an engine controller 202 via a controller (video controller) 201 which is a control unit. In this embodiment, a standard image forming mode is a normal print mode, and a density-variable image forming mode is a wide color gamut print mode.

Figure 2:
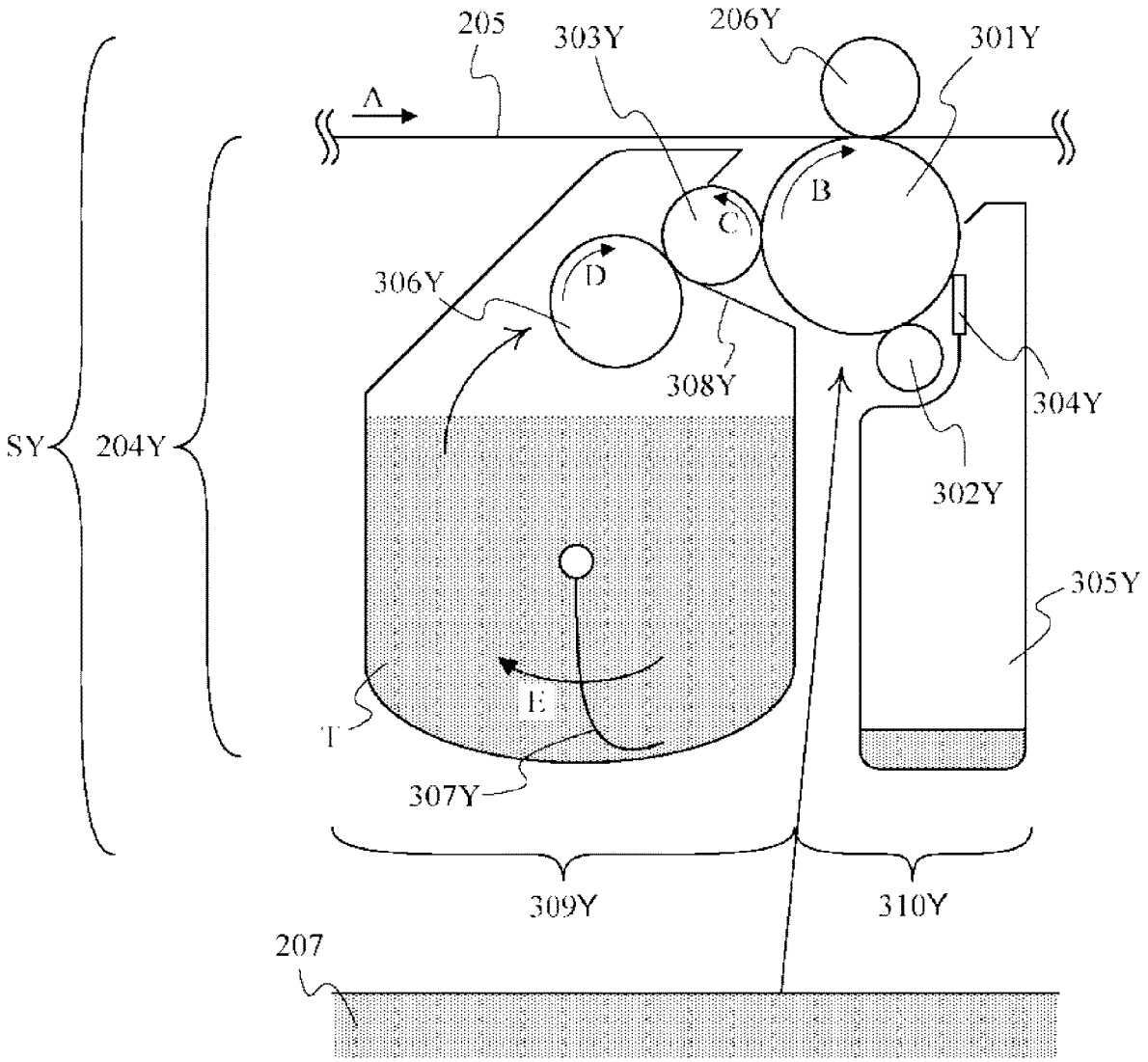
FIG. 2 is a schematic diagram depicting a configuration of a primary transfer image forming station according to Embodiment 1.

The image forming apparatus 200 includes image forming stations SY, SM, SC and SK corresponding to each color. For example, FIG. 2 illustrates the image forming station SY corresponding to yellow. The image forming station SY includes a processing cartridge 204Y, an intermediate transfer belt 205 which rotates in the arrow A direction indicated in FIG. 2, and a primary transfer roller 206Y which is disposed on the opposite side of the process cartridge 204Y via the intermediate transfer belt 205. The image forming stations SY, SM, SC and SK are disposed side-by-side in the rotation direction of the intermediate transfer belt 205, and are substantially the same except for the color to be formed. Hence in the following, the image forming stations are described in general, omitting the suffixes Y, M, C and K that indicate each color of the image forming stations, unless differentiation is especially required.

The process cartridge 204 includes a photosensitive drum 301 (image bearing member). The photosensitive drum 301 is rotary-driven by a driving unit (not illustrated) in the arrow B direction indicated in FIG. 2. A charging roller 302 uniformly charges the surface of the photosensitive drum 301 by applying high voltage from a high voltage power supply (not illustrated). Then a scanner unit 207 (exposure unit) irradiates a laser to the photosensitive drum 301 based on image information that is inputted to an engine controller 202, and forms an electrostatic latent image on the surface of the photosensitive drum 301. A developing roller 303 (developer feeding unit) is rotated by a driving unit (not illustrated) in the arrow C direction indicated by FIG. 2, and charged toner as a developer, which is coated on the surface of the developing roller 303, is attached to the electrostatic latent image on the surface of the photosensitive drum 301, whereby the electrostatic latent image becomes a visible image. Hereafter a visible image visualized by toner is called a "toner image". A base layer of the photosensitive drum 301 is grounded, and voltage having reverse polarity of toner is applied to the primary transfer roller 206 by a high voltage power supply (not illustrated). Therefore, a transfer electric field is formed in a nip between the primary transfer roller 206 and the photosensitive drum 301, and the toner image is transferred from the photosensitive drum 301 to the intermediate transfer belt 205 (intermediate transfer member). Untransferred toner that remains on the surface of the photosensitive drum 301 is removed from the photosensitive drum 301 by a drum cleaning blade 304, and is collected in a waste toner container 305.

A toner replenishing roller 306 rotates in the arrow D direction indicated in FIG. 2, so as to replenish toner to the developing roller 303, and a stirring unit 307 rotates in the arrow E direction indicated in FIG. 2, so as to replenish toner to the toner replenishing roller 306. A toner regulating blade (developing blade) 308 is fixed, hence the developing roller 303, which is rotating, is rubbed by the toner regulating blade 308. This rubbing portion charges the toner coated on the surface of the developing roller 303 while controlling the amount of toner, whereby the developing can be performed at stable density. Hereafter a configuration constituted by the developing roller 303, the stirring unit 307, the toner replenishing roller 306 and the toner regulating blade 308 is called a "developing unit 309". A configuration constituted of the photosensitive drum 301, the charging roller 302, the drum cleaning blade 304 and the waste toner container 305 is called a "drum unit 310".

By the intermediate transfer belt 205 rotating in the arrow A direction indicated in FIG. 2, the toner image generated by the image station S for each color is formed on the intermediate transfer belt 205, and is transported. Recording material 203 is stacked and stored in a paper feeding cassette 208. The recording material 203 is fed by the paper feeding roller 209 that is driven based on a paper feeding start signal. The recording material 203 is transported to a contact nip portion between a secondary transfer roller 211 and a secondary transfer counter roller 212 via a resist roller pair 210 at a predetermined timing. In concrete terms, the recording material 203 is transported at a timing when the tip of the toner image on the intermediate transfer belt 205 and the tip of the recording material 203 overlap.

While the recording material 203 is held by and transported between the secondary transfer roller 211 and the secondary transfer counter roller 212, voltage having reverse polarity to toner is applied to the secondary transfer roller 211 from a power supply device (not illustrated). Since the secondary transfer counter roller 212 is grounded, a transfer electric field is formed between the secondary transfer roller 211 and the secondary transfer counter roller 212. By this transfer electric field, the toner image is transferred from the intermediate transfer belt 205 to the recording material 203. After passing through the nip between the secondary transfer roller 211 and the secondary transfer counter roller 212, the recording material 203 is heated and pressed by a fixing apparatus 213. Thereby the toner image on the recording material 203 is fixed to the recording material 203. Then the recording material 203 is transported to a paper delivery tray 215 via a paper outlet 214, and the image forming process is completed. The toner remaining on the intermediate transfer belt 205, which was not transferred by the secondary transfer unit, is removed from the intermediate transfer belt 205 by a cleaning member 216, whereby the intermediate transfer belt 205 is refreshed to a state where image forming can be performed again.

Control Block Diagram

Figure 18:
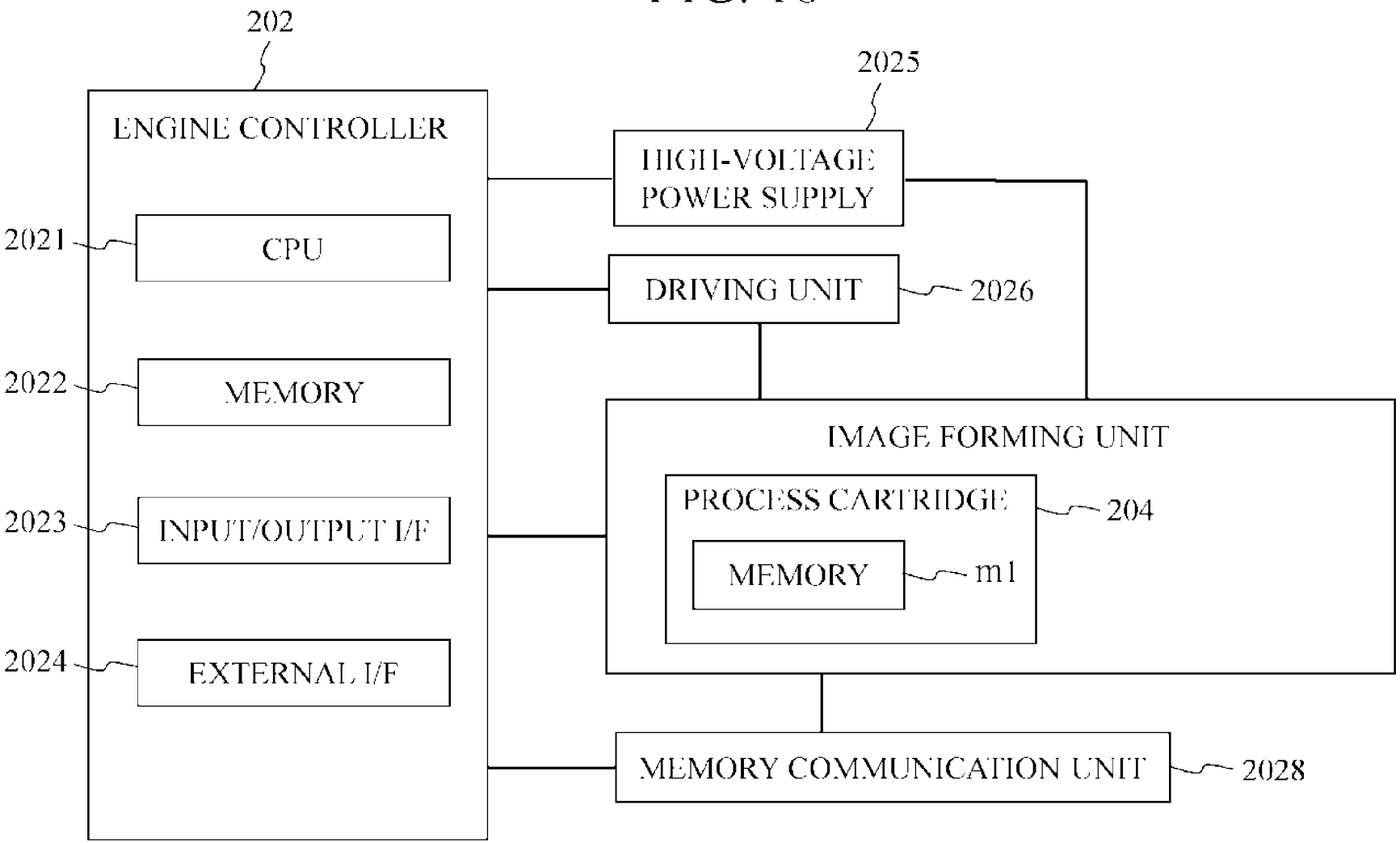
FIG. 18 is a block diagram depicting the hardware of the image forming apparatus according to Embodiment 1.

FIG. 18 is a block diagram depicting the hardware of the image forming apparatus according to this embodiment. The engine controller 202 of the image forming apparatus 200 includes a CPU 2021 which executes various calculation processing and various kinds of processing in the later-mentioned flow chart, and outputs instructions to each peripheral unit. The engine controller 202 also includes a memory 2022 on the apparatus main unit side, where information required to control a driving unit 2026 (e.g., motor) and a high voltage power supply 2025 is stored. The information stored in the memory ml of the process cartridge 204 is inputted and read by the CPU 2021 via a memory communication unit 2028 and an input/output interface (I/F) 2023. Output of an instruction to each peripheral unit and output of information to each peripheral unit are performed by the CPU 2021 via the input/output I/F 2023. Transfer of information between the controller 201 and the engine controller 202, and transfer of information to an external device (e.g., display) are performed by the CPU 2021 via the external I/F 2024. The image forming unit referred to in the drawings is the generic name of the scanner unit 207, the process cartridge 204, an intermediate transfer belt 205, a fixing apparatus 213, and a mechanical gear to operate these units, described with reference to FIG. 1. The high voltage power supply 2025 and the driving unit 2026 may also be regarded as a part of the image forming unit. The block configuration of the controller 201 described above with reference to FIG. 1 is the same as that of the engine controller 202.

Configuration of Photosensitive Drum Layer

Figure 3:
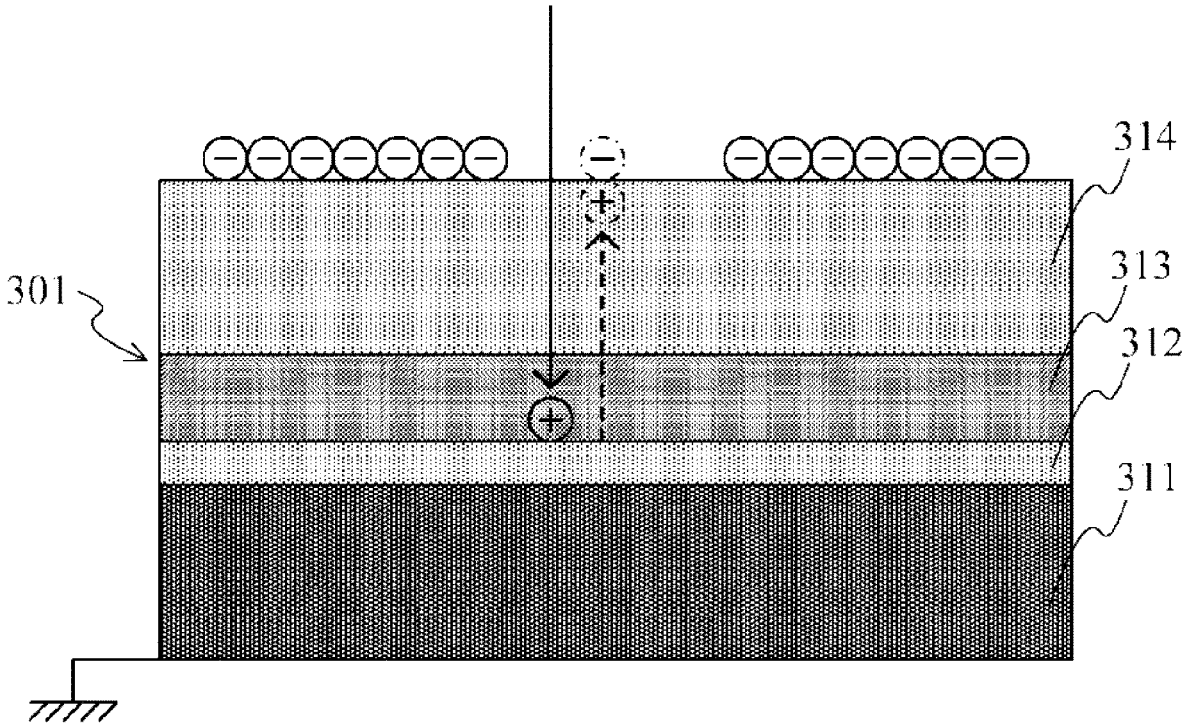
FIG. 3 is a schematic diagram depicting a configuration of a photosensitive drum layer according to Embodiment 1.

FIG. 3 indicates the layer configuration of the photosensitive drum 301. The photosensitive drum 301 is mainly configured by, in order from the lower layer: a drum substrate 311 which is made of such conductive material as aluminum; an undercoating layer 312 which suppresses the interference of light and improves adhesion with the upper layer; a charge generation layer 313 which generates carriers; and a charge transport layer 314 which transports generated carriers. The drum substrate 311 is grounded, and an electric field from inside to outside the photosensitive drum 301 is formed by the surface of the photosensitive drum 301 that is charged by the charging roller 302. When the light from the scanner unit 207 is irradiated to the photosensitive drum 301, carriers are generated in the charge generation layer 313. These carriers are moved by the above-mentioned electric field, and form pairs with the charges on the surface of the photosensitive drum 301, whereby the surface potential of the photosensitive drum 301 is changed.

In this configuration, in addition to the normal print mode as the first mode, a wide color gamut print mode is included as the second print mode. The wide color gamut print mode is a print mode to widen the color gamut of the normal print mode. This is implemented by increasing the toner amount on the photosensitive drum 301 compared with that in the normal print mode. In order to increase the toner amount on the photosensitive drum 301, the peripheral velocity ratio of the developing roller 303, with respect to the photosensitive drum 301, and potential setting are optimized in this embodiment.

Difference of Peripheral Velocity of Developing Roller and Toner Supply Amount

Figure 4A:
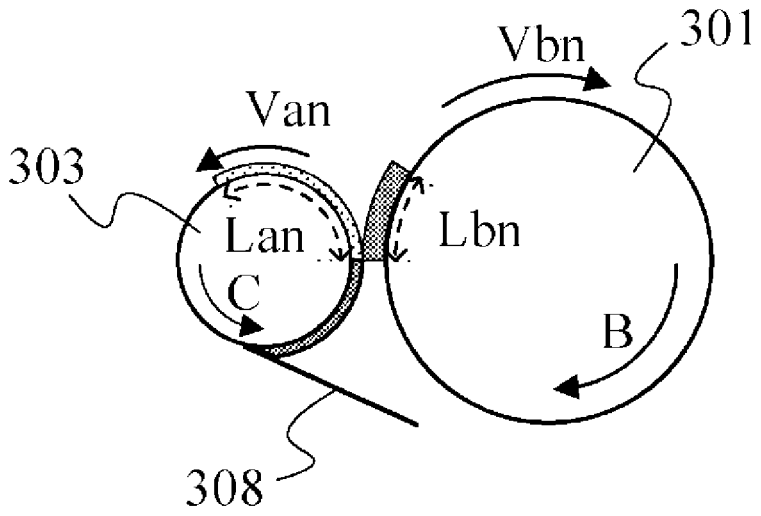
FIG. 4A and FIG. 4B are schematic diagrams depicting toner supply amount depending on the difference of the peripheral velocity of developing rollers according to Embodiment 1.

The relationship between the peripheral velocity ratio and the toner amount on the photosensitive drum 301 will be described with reference to FIG. 4A and FIG. 4B. FIG. 4A indicates the developing amount from the developing roller 303 to the photosensitive drum 301 per unit time in the normal print mode. The developing roller 303 rotates in the rotation direction C, and the toner is coated on the surface thereof. The photosensitive drum 301 rotates in the rotation direction B in the state of contacting with the developing roller 303. The toner controlled by the toner regulating blade 308 is developed from the developing roller 303 to the photosensitive drum 301 in the nip portion of the developing roller 303 and the photosensitive drum 301.

Here it is assumed that the peripheral velocity of the developing roller 303 is $Va_n$, the peripheral velocity of the photosensitive drum 301 is $Vb_n$, the length of the surface of the developing roller 303 developed per unit time is $La_n$, and the length of the surface of the photosensitive drum 301 developed per unit time is $Lb_n$. These parameters have a relationship given by Expression (1).

$$Va_n/Vb_n=La_n/Lb_n \tag{1}$$

Figure 4B:
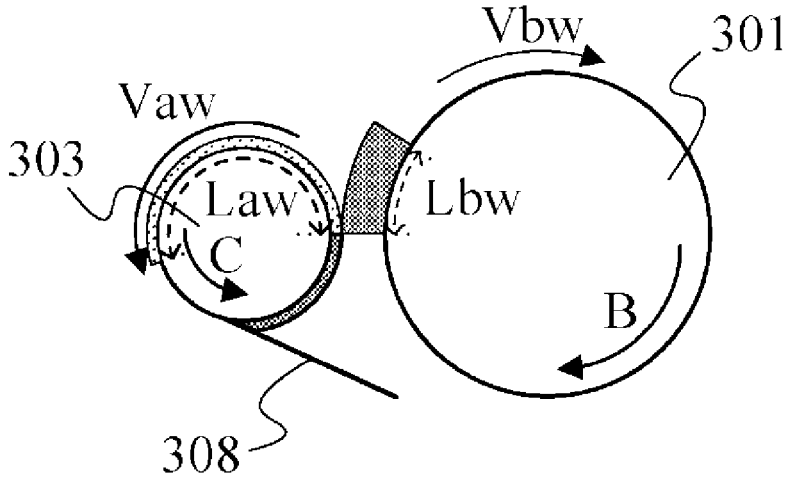

In the wide color gamut print mode as well, just like the normal print mode, it is assumed that the peripheral velocity of the developing roller 303 is $Va_w$, the peripheral velocity of the photosensitive drum 301 is $Vb_w$, the length of the surface of the developing roller 303 developed per unit time is $La_w$, and the length of the surface of the photosensitive drum 301 developed per unit time is $Lb_w$, as illustrated in FIG. 4B. In this case as well, the parameters have a relationship given by Expression (2).

$$Va_w/Vb_w=La_w/Lb_w \tag{2}$$

$Va_n/Vb_n$ and $Va_w/Vb_w$ are called "peripheral velocity ratios". In this embodiment, it is assumed that the peripheral velocity ratio in the normal print mode is $Va_n/Vb_n=1.4$, and the peripheral velocity ratio in the wide color gamut print mode is $Va_w/Vb_w=2.2$. In the case of $Lb_n=Lb_w$, $La_w/La_n=2.2/1.4$ is established. This means that if the development efficiency from the developing roller 303 to the photosensitive drum 301 is 100%, the peripheral velocity ratio indicates the ratio of the toner amount on the surface of the photosensitive drum 301. Setting the peripheral velocity of the developing roller 303 to $Va_n$ or $Va_w$, the peripheral velocity of the photosensitive drum 301 to $Vb_n$ or $Vb_w$, as described above, can be implemented by the CPU 2021 instructing operation to the drive unit 2026.

Surface Potential of Photosensitive Drum

Figure 5:
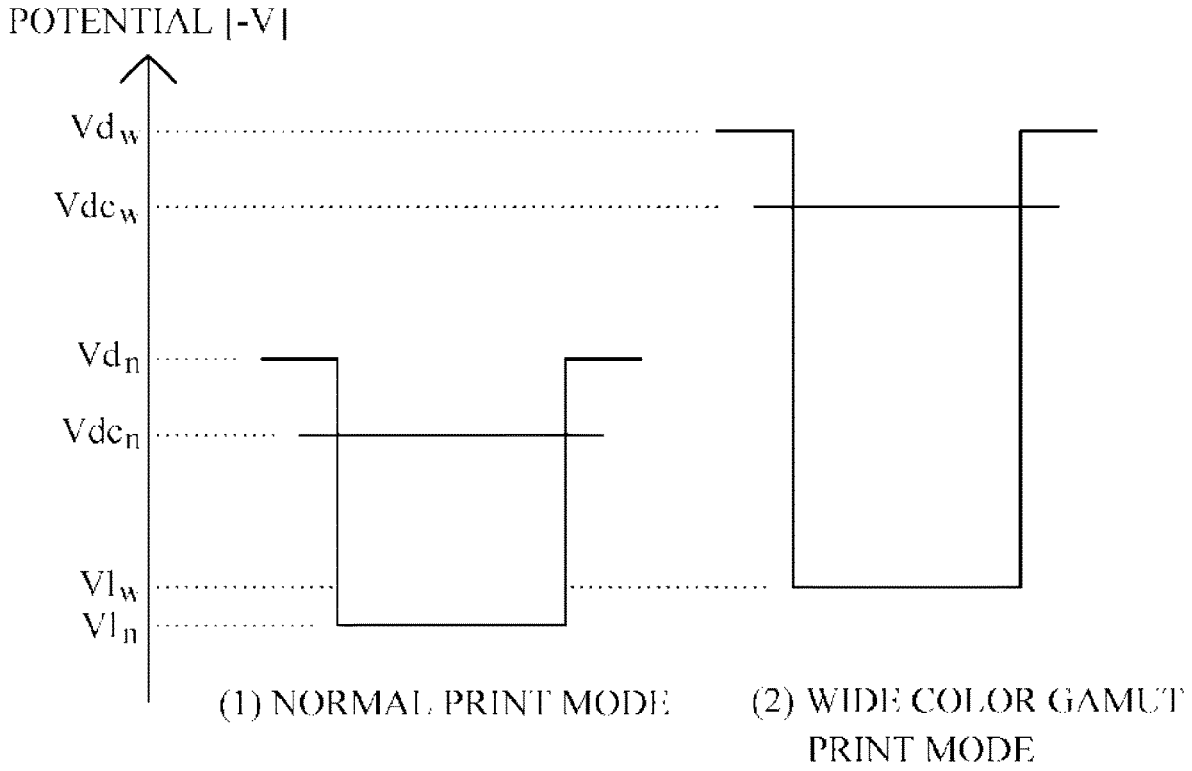
FIG. 5 is a schematic diagram depicting a surface potential of a photosensitive drum according to Embodiment 1.

To make the development efficiency 100% in both the normal print mode and the wide color gamut print mode, the potential is set as indicated in FIG. 5. First the potential, when the surface of the photosensitive drum 301 is charged by the charging roller 302, is assumed to be the charging potential Vd. By the exposure thereafter, the surface potential of the photosensitive drum 301 changes to the exposure potential Vl. Voltage has been applied to the developing roller 303 by a high voltage power supply (not illustrated), so as to have a developing potential Vdc. The developing potential Vdc is set to a potential between the exposure potential Vl and the charging potential Vd, hence an electric field is formed in the non-exposure portion in a reverse direction of the direction of the toner, which is coated on the surface of the developing roller 303, that is developed at the photosensitive drum 301 side, and an electric field is formed in an exposure portion in a direction of the toner that is developed at the photosensitive drum 301 side. By this electric field, toner is developed in the exposure portion, but as the toner is developed, the electric field in the exposure portion weakens since the surface potential of the photosensitive drum 301 is increased by the toner charges. Therefore, even if the toner supplying amount is increased by increasing the peripheral velocity ratio, the toner amount on the photosensitive drum 301 saturates at a certain peripheral velocity ratio. In order to increase the toner amount on the photosensitive drum 301, sufficient potential contrast Vdc−Vl (≡Vcont) must be set. However even if the exposure amount is increased in a state where the charges generated by the charging bias sufficiently dissipate by exposure, carriers generated in the charge generation layer 313 do not migrate to the surface because the electric field inside the photosensitive drum 301 is weak, and as a result, the potential does not change. This means that a higher charging bias is required to set a higher potential contrast.

Therefore, in the normal print mode according to the configuration of this embodiment, Vdn=−500V, Vdcn=−350V and Vln=−100V are used. Further, in the wide color gamut print mode, Vdw=−850V, Vdcw=−600V and Vlw=−120V are used. Here the charging bias Vd, the developing potential Vdc and the exposure potential Vl are denoted as Vdn, Vdcn and Vln in the normal print mode, and are denoted as Vdw, Vdcw and Vlw in the wide color gamut print mode. Each potential in each print mode is set to a value that is sufficient to develop the toner coated on the surface of the developing roller 303.

The above-mentioned Vdn=−500V, Vdcn=−350V, Vdw=−850V and Vdcw=−600V are implemented by the CPU 2021 controlling and instructing the high voltage power supply (not illustrated) connected to the charging roller 302 and the developing roller 303. Here the high voltage power supply 2025 described above is assumed to be a generic term of the high voltage power supply connected to each member. The high voltage power supply to each member may not be an independent power supply, but may be a common high voltage power supply which outputs various high voltages by resistive voltage division.

Density Detection

Figure 6:
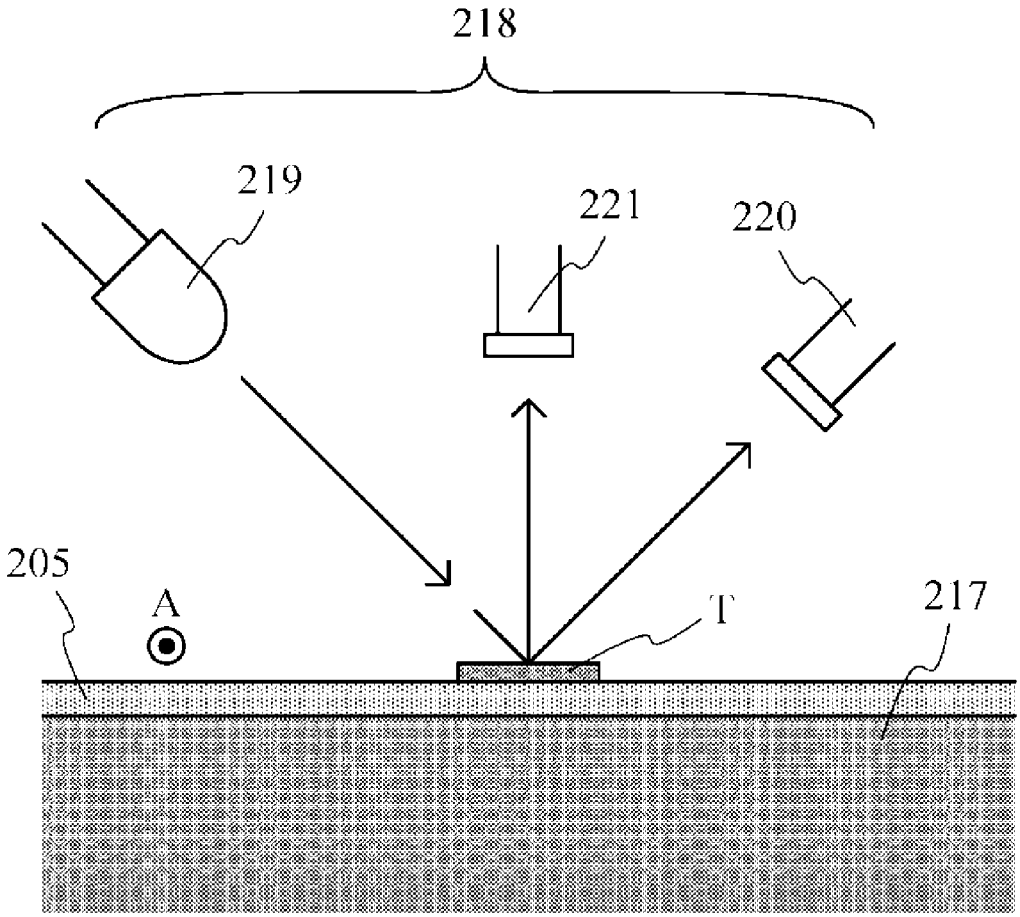
FIG. 6 is a schematic diagram depicting the configuration of a density detection sensor according to Embodiment 1.

In the electrophotographic type image forming apparatus, the tinge of the printed matter changes depending on various conditions, such as the durability of the cartridge and the operating environment. Therefore, it is necessary to measure the density at an appropriate timing and to feedback the measurement results to the control mechanism of the main unit. FIG. 6 is a general configuration of a density detection sensor 218 as the density detection unit. The toner image is transferred to the surface of the intermediate transfer belt 205 by the image forming station S, and is then transported to the position of a counter roller 217 by the rotation of the intermediate transfer belt 205. The counter roller 217 and the density detection sensor 218 are disposed opposite from each other with respect to the intermediate transfer belt 205. The density detection sensor 218 is mainly constituted of a light-emitting element 219, a normal reflection light-receiving element 220 and a diffused reflection light-receiving element 221. The light-emitting element 219 emits infrared light, and this light is reflected by the surface of the toner image T. The normal reflection light-receiving element 220 is disposed in the normal reflection direction of the position of the toner image T, and detects the normal reflection light from the position of the toner image T. The diffused reflection light-receiving element 221 is disposed in a direction other than the normal reflection direction of the toner image T, and detects the diffused reflection light from the position of the toner image T.

Figure 7:
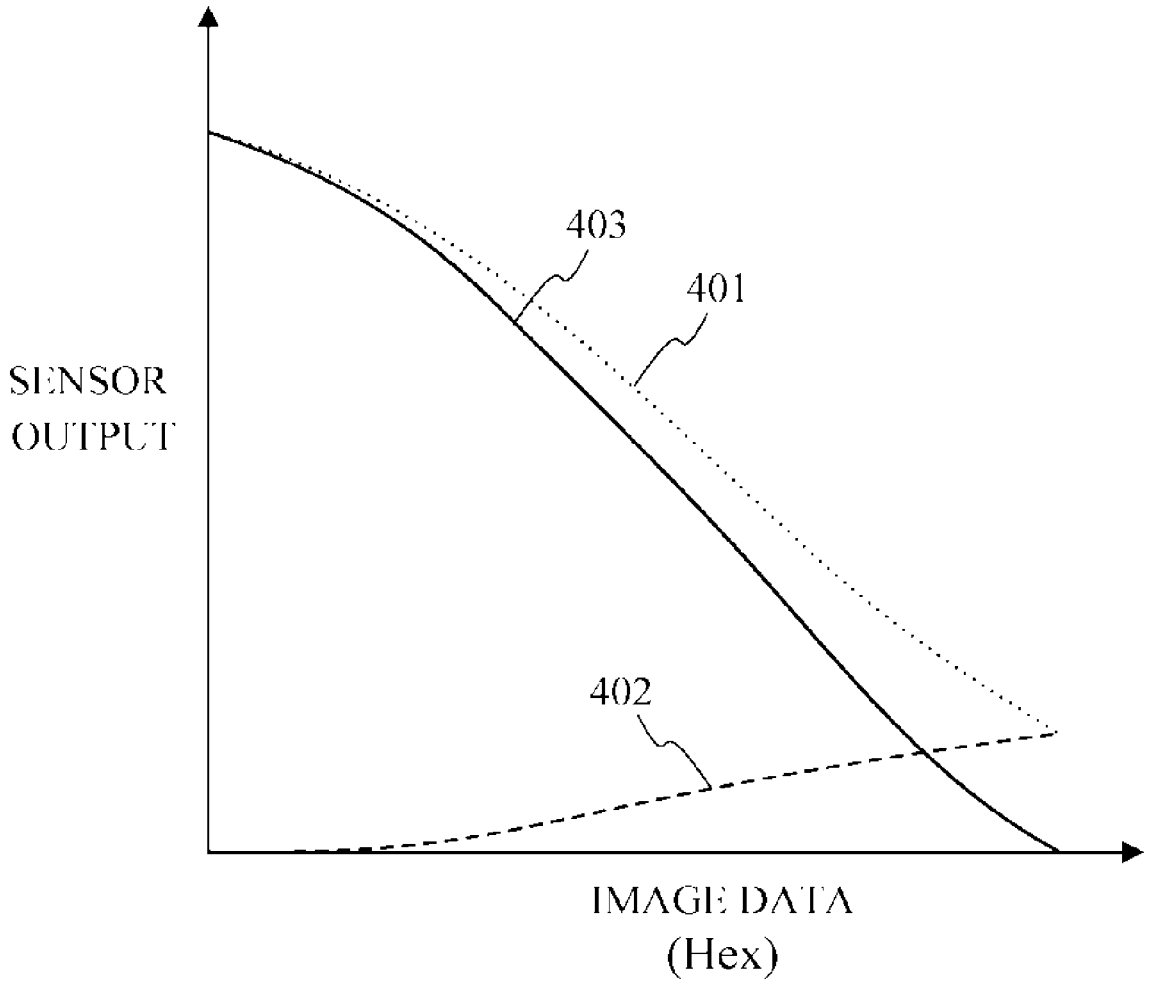
FIG. 7 is a diagram depicting the output of the density detection sensor according to Embodiment 1.

FIG. 7 indicates the result of the sensor output. In the case of toner image T of which toner amount is low, reflection from the surface of the intermediate transfer belt 205, which has a smooth mirror surface, is detected more so, hence the normal reflection detection output 401 is high, and the diffused reflection detection output 402 is low. The toner particle size is large compared with the surface smoothness of the intermediate transfer belt 205, hence the normal reflection detection output 401 decreases and the diffused reflection detection output 402 increases as toner increases. The normal reflection detection output 401 includes the diffused reflection component, therefore the sensor output 403 correlated with the density can be acquired by subtracting the diffused reflection component from the normal reflection detection output 401 based on the diffused reflection detection output 402. Further, the CPU 2021 can acquire an even more accurate density value by removing the influence of the substrate of the intermediate transfer belt 205 at a position where a toner patch is formed. In this way, the density is calculated based on the detection results of the normal reflection light and the diffused reflection light.

Controller Processing Flow

Figure 8:
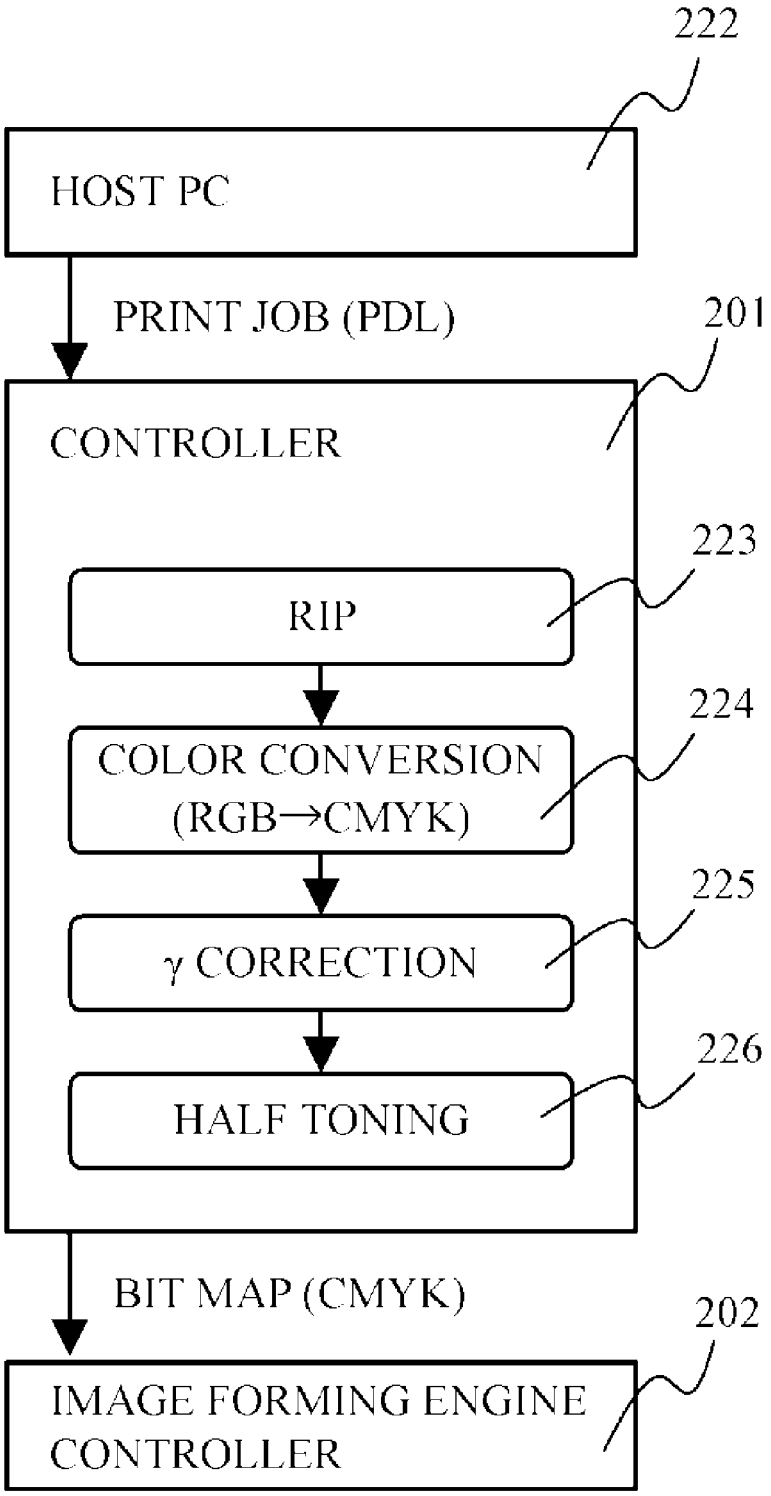
FIG. 8 is a schematic diagram depicting a processing flow of a controller according to Embodiment 1.

Now how tinge information (value determined by converting the density value into the chromaticity difference) acquired by the density detection sensor 218 is used for correction will be described. FIG. 8 indicates the outline of the controller processing flow. Generally, a print job written in a page description language (PDL), such as PCL or PostScript, is sent from a host PC 222 or the like to the controller 201. The controller 201 sends the YMCK bit map information to the engine controller 202 mainly via a raster image processor (RIP) unit 223, a color conversion unit 224, a γ correction unit 225 and a halftoning unit 226. In concrete terms, the RIP unit 223 analyzes (interprets) the file of the print job written in PDL, which was sent from the host PC 222, and performs bit mapping RGB in accordance with the resolution of the image forming apparatus 200. Normally, the color reproduction range of an electrophotographic type image forming apparatus is narrower than the color reproduction range of the liquid crystal display. Therefore, the color conversion unit 224 performs color matching next, considering the difference of the color reproduction ranges between devices, so as to match the tinges as much as possible. Also, the RGB data is converted into YMCK data. Then the γ correction unit 225 performs gamma correction. The halftoning unit 226 performs gradation expression processing, such as dithering (dithering processing), using a dither pattern or a dither matrix. The detection result acquired by the density detection sensor 218 is used by the γ correction unit 225 to select appropriate image data.

γ Characteristic Based on Dithering of Comparative Example

Figure 9:
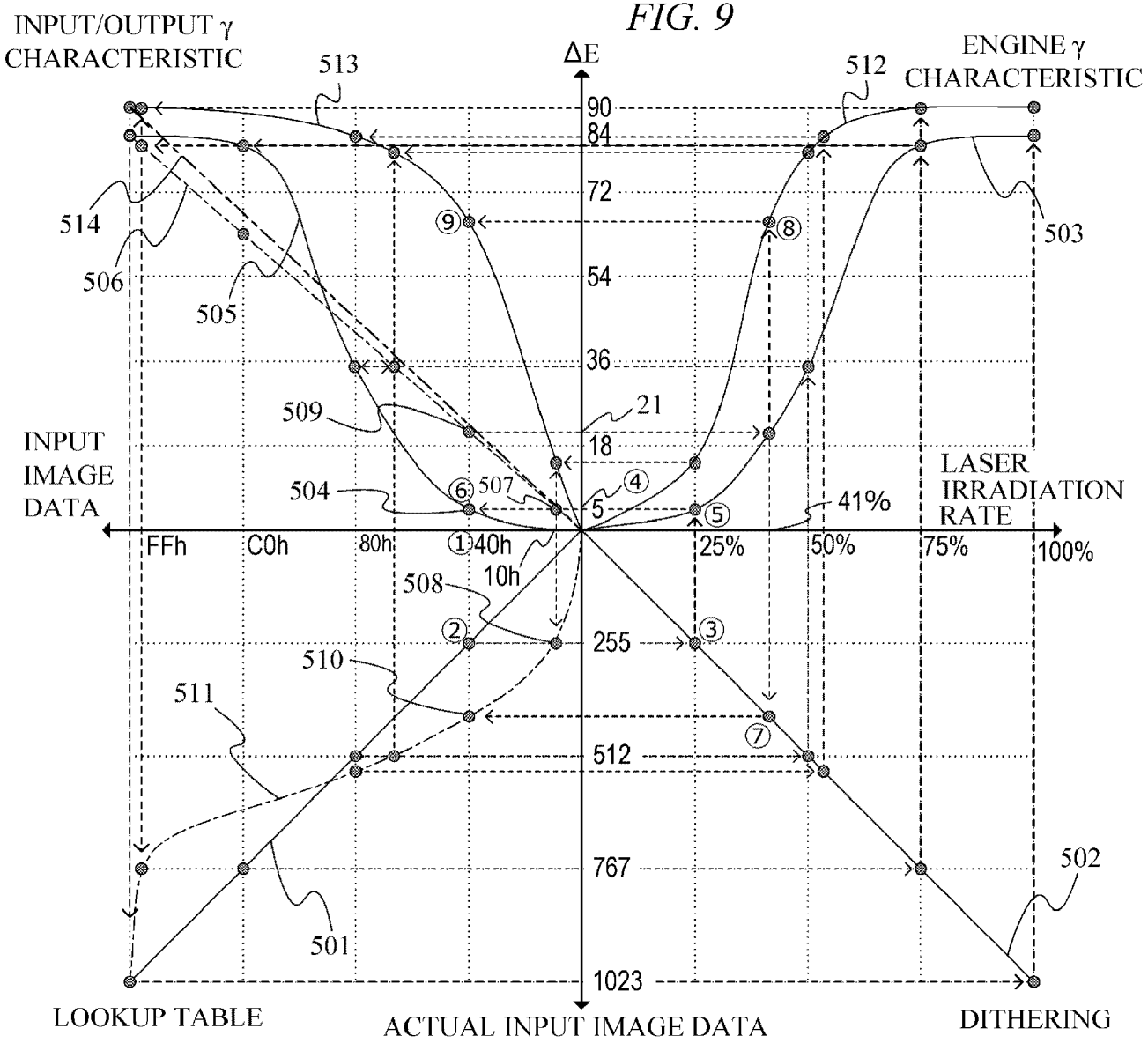
FIG. 9 is a schematic diagram depicting a γ characteristic based on a dithering according to a comparative example.

FIG. 9 indicates an example of a γ characteristic based on the dithering of a comparative example, and the γ correction processing by the γ correction unit 225 will be described with reference to FIG. 9. FIG. 9 is a graph that expresses the relationship between the input image data and the chromaticity difference of the output image by shifting in the sequence of the third quadrant, the fourth quadrant, the first quadrant and the second quadrant.

The third quadrant indicates a state of converting the input image data input to the γ correction unit 225 into actual input image data using a look-up table (LUT). The "actual input image data" refers to the input image data after the conversion using the look-up table, which is data to be inputted to the function block (halftoning unit 226) that comes after the γ correction unit 225.

The input image data before the conversion increases in the left direction of the abscissa, and has an 8-bit (256 gradation) resolution in this embodiment. Actual input image data after the conversion, on the other hand, increases in the downward direction of the ordinate. A table that indicates the relationship of this input data is called a "look-up table", and the γ correction unit 225 performs the γ correction by changing this look-up table.

In the look-up table 501 which is not γ-corrected, the value of the input image data and the value of the actual input image data change in the same manner, that is, in a linear relationship. In terms of the accuracy of the γ correction, it is preferable that the actual input image data has a higher resolution compared with the input image data, and in the case of the configuration of this embodiment, the actual input image data has a 10-bit (1024 gradation) resolution. The look-up table 511 after the γ correction (γ-corrected look-up table 511) is the look-up table that is finally acquired in the comparative example.

The fourth quadrant indicates the relationship between an exposure condition (i.e. the laser irradiation rate) converted as the result of performing the dithering with respect to the actual input image data when exposure is performed. This relationship indicated in the fourth quadrant is called "dithering" in this embodiment. The laser irradiation rate indicates an area ratio (ratio) of an area irradiated by laser with respect to the unit area, which increases in the right direction of the abscissa. For example, when the laser irradiation rate is 50%, half of the unit area is exposed by the laser. In concrete terms, when the laser is irradiated, the light quantity is not changed, but the irradiation area is changed by the PWM modulation. In FIG. 9 percentage is indicated, but actually the laser irradiation rate is not indicated in every % unit, and resolution changes depending on the number of lines, screen angle and PWM to be used. As the dithering 502 in the fourth quadrant indicates, in the comparative example, the actual input image data and the laser irradiation rate are in a linear relationship, and the same dithering 502 is performed for both the normal print mode and the wide color gamut mode. The dithering 502 means the dithering processing that converts the input image data of a certain density into the predetermined laser irradiation rate.

The first quadrant indicates the relationship between the laser irradiation rate and ΔE, and this relationship is called the "engine γ characteristic" in this embodiment.

A value in the upward direction of the ordinate indicates a chromaticity difference (ΔE) between a portion on which toner exists and a portion on which toner does not exist, and increases in the upward direction of the ordinate. In this embodiment, ΔE is the correction target of the γ correction unit 225. The target, however, is not limited to the chromaticity difference (ΔE), and may be the density or the like instead of ΔE. For example, the chromaticity difference may be the difference between the detected and converted chromaticity and the chromaticity of the white portion of a specific type of paper. The chromaticity of the white portion may be changed when necessary.

The engine γ characteristic, which indicates the correspondence of the laser irradiation rate (exposure condition) and the density indicated in the first quadrant, changes depending on the image forming mode, the time dependent conditions (e.g., use state of cartridge, use state of main unit), and the environmental conditions (e.g., use amount of toner, installation environment of main unit). Therefore, while continuously operating the image forming apparatus, it is necessary to measure ΔE and perform γ correction using the γ correction unit 225 when necessary. In this case, the engine stops print operation, enters the calibration mode, and performs calibration sequence operation.

In the calibration sequence, an image is formed using the look-up table 501 without γ correction. In the normal print mode, the density is detected by the density detection sensor 218, which also calculates the result ΔE. Furthermore, using this ΔE, the density detection sensor 218 also calculates ΔE in the wide color gamut print mode.

Therefore, an error, which is generated when the ΔE in the wide color gamut print mode differs from the ΔE in the normal print mode, is expressed as an error of the engine γ characteristic. Using the acquired γ characteristics, the γ correction unit 225 corrects the look-up table. Thereby the γ correction is completed.

The relationship between the input image data and ΔE acquired above is called the "input/output γ characteristic", and is expressed in the second quadrant.

The flow of γ correction will be described using a concrete example. It is assumed that an image based on the input data image of which value is 40 h is formed. This input image data is written in the graph as a number "1" that is enclosed within a circle. Hereafter, the number "1" that is enclosed within a circle in the graph is expressed as "sign (1)" in this description. This is the same for subsequent circled numbers. According to the look-up table 501 before γ correction, the actual input image data is 255 (sign (2)). The input image data 255 is converted into the laser irradiation rate by the dithering 502, and the result is 25% (sign (3)).

Further, it is assumed that the measurement result of the density detection sensor 218 is ΔE=5 (sign (4)). The intersection between the sign (3) and the sign (4) indicates the engine γ characteristic when the value of the input image data is 40 h (sign (5)). For other input image data as well, the conversion into the laser irradiation rate and the measurement of ΔE are performed, then the engine γ characteristic 503 in the normal print mode is acquired.

Based on the measurement result ΔE=5 when the input image data is 40 h, the point 504 is acquired (sign (6)). By performing the plotting in the same manner for the relationship between the other input image data and ΔE, the input/output γ characteristic 505 in the normal print mode is acquired.

Here it is assumed that the relationship in which ΔE changes linearly in accordance with the value of the input image data is an ideal input/output γ characteristic 506 in the normal print mode. Then the ideal input/output γ characteristic 506 in the normal print mode and the input/output γ characteristic 505 in the (actual) normal print mode have different profiles, which means that γ correction is required. The ideal input/output γ characteristic 506 in the normal print mode here is the case of the normal print mode, and in the case of the wide color gamut print mode, an image having a larger ΔE than the case of the normal print mode is formed based on the same input image data as the normal print mode, hence the ideal input/output γ characteristic 514 is the target in the wide color gamut print mode.

In the ideal input/output γ characteristic 506 in the normal print mode, the input image data that implements ΔE=5 is 10 h (point 507). In order to establish this relationship, the actual input image data should be 255 when the input image data is 10 h, since the laser irradiation rate when ΔE=5 is 25% according to the engine γ characteristic 503 in the normal print mode, and the actual input image data to implement the laser irradiation rate 25% is 255. As a result, the point 508 is derived. By performing the plotting in the same manner for the other input image data, the γ-corrected look-up table 511 is derived.

The γ-corrected look-up table 511 can also be derived as follows. According to the point 509 of the ideal input/output γ characteristic 506 in the normal mode, ΔE should be ΔE=21 if the input image is 40 h. This means that the laser irradiation rate must be 41% based on the engine γ characteristic 503. By plotting the relationship between the actual input image data and this input image data based on the dithering 502, the point 510 is derived.

However if the γ-corrected look-up table 511 acquired like this is used for the engine γ characteristic 512 in the wide color gamut print mode and an image is formed, the input/output γ characteristic becomes the actual wide color gamut γ characteristic (input/output γ characteristic) 513 instead of the ideal wide color gamut γ characteristic (input/output γ characteristic) 514.

For example, it is assumed that the value of the input image data is 40 h (sign (1)). First a point 510 is determined by the γ-corrected look-up table 511. Then this data is converted into the laser irradiation data using the dithering 502 (sign (7)). Then ΔE is determined based on the engine γ characteristic 512 in the wide color gamut print mode (sign (8)). Then ΔE (sign (8)) in the wide color gamut mode and the value 40 h of the input image data are plotted (sign (9)). By performing this plotting for the other input image data, the input/output γ characteristic 513 in the actual wide color gamut print mode is acquired.

Here as indicated in the first quadrant, the normal engine γ characteristic 503 and the engine γ characteristic 512 in the wide color gamut print mode are different. This difference is generated due to the difference in the latent image formation and the number of toner layers, for example. In other words, in the case of the wide color gamut print mode, a number of toner layers is larger and the light quantity by the scanner unit 207 is higher, which makes the latent image slightly larger, compared with the normal print mode, hence ΔE becomes larger than the case of the normal print mode when compared with the same laser irradiation rate.

As a consequence, a γ-corrected look-up table for the wide color gamut is required separately from the γ-corrected look-up table 511 for the normal print mode. For this, it is necessary to acquire the engine γ characteristic 512 in the wide color gamut when necessary. However, if the image formation and density detection are performed, and the engine γ characteristic is acquired in the same manner as in the normal print mode to create the look-up table in the wide color gamut print mode, the downtime of the image forming apparatus is prolonged. Therefore, in this embodiment, ΔE in the wide color gamut print mode is calculated from ΔE in the normal print mode in order to decrease the downtime.

Chromaticity Calculation Table in Wide Color Gamut Print Mode

FIG. 10A is a part of a table (second conversion table) to calculate ΔE in the wide color gamut print mode (hereafter ΔE (LGT)) from ΔE in the normal print mode (hereafter ΔE (Normal)). This table is stored in advance in the memory 2022 described in the block diagram. The vertical direction indicates the gradation values of ΔE (Normal) and the horizontal direction indicates the sub-tables used for each drum lifetime, where the sub-table 521 used in the case where the drum lifetime is 100%, the sub-table 522 used in the case where the drum lifetime is 80% and the like are arranged in order from the left. The sub-tables used down to the drum lifetime 0% actually exist, but are omitted here since the method of calculating ΔE (LGT (wide color gamut)) is the same. Each sub-table for each drum lifetime includes a plurality of small tables for each developing device lifetime.

In the case where the drum lifetime and the developing device lifetime are not included in FIG. 10A, a desired value is calculated by performing interpolation processing (e.g., linear interpolation) using each table. For example, a method of calculating ΔE (LGT) in the case of the drum lifetime 90% and developing device lifetime 90% will be described with reference to FIG. 10B.

Step 1

The sub-table 521 and the sub-table 522 to interpolate the drum lifetime 90% are selected. Further, the small tables 521*a* and 521*b* (used when the drum lifetime is 100%) and the small tables 522*a* and 522*b* (used when the drum life is 80%) to interpolate the developing device lifetime 90% are selected.

Step 2

The small tables 521*c* and 522*c* for the developing device lifetime 90% are derived by performing linear interpolation based on the developing device lifetime.

Step 3

The sub-table 523 for the drum lifetime 90% and the developing device lifetime 90% is derived by performing linear interpolation based on the drum lifetime.

The values indicated in the sub-table 523 are ΔE (LGT)-ΔE (Normal). Therefore, by adding ΔE (Normal) to a value indicated in the table, ΔE (LGT) is calculated/converted. Thereby, ΔE (LGT) is calculated, but the table may be sub-divided so that the factors that change the tinge (e.g., installation environment of main unit) are included. If the required value of ΔE (Normal) is not in the sub-table 523, the liner interpolation may be further performed.

Here the state of each composing element of the image forming apparatus is determined as a component lifetime. This component lifetime can be regarded as a degree of component use. The degree of component use can be acquired by the controller 201 measuring the operation time of each component or a number of rotations (in the case of a drum and roller), and comparing the result with an assumed operation time or an assumed number of rotations, for example. The table in accordance with the operation time or the number of rotations, instead of the component lifetime, may be created. Further, to determine ΔE (LGT), a mathematical expression that indicates the relationship between ΔE (LGT) and ΔE (Normal) may be created and used, instead of the above-mentioned predetermined table.

To create the table in FIG. 10A and FIG. 10B, ΔE in the normal print mode and ΔE in the wide color gamut print mode, which are actually measured by the density detection sensor 218 under various conditions, are compared. The tables in FIG. 10A and FIG. 10B are assumed to be provided for each color, and be stored in the memory 2022 in advance.

γ Characteristic Based on Dithering of Embodiment 1

Figure 11:
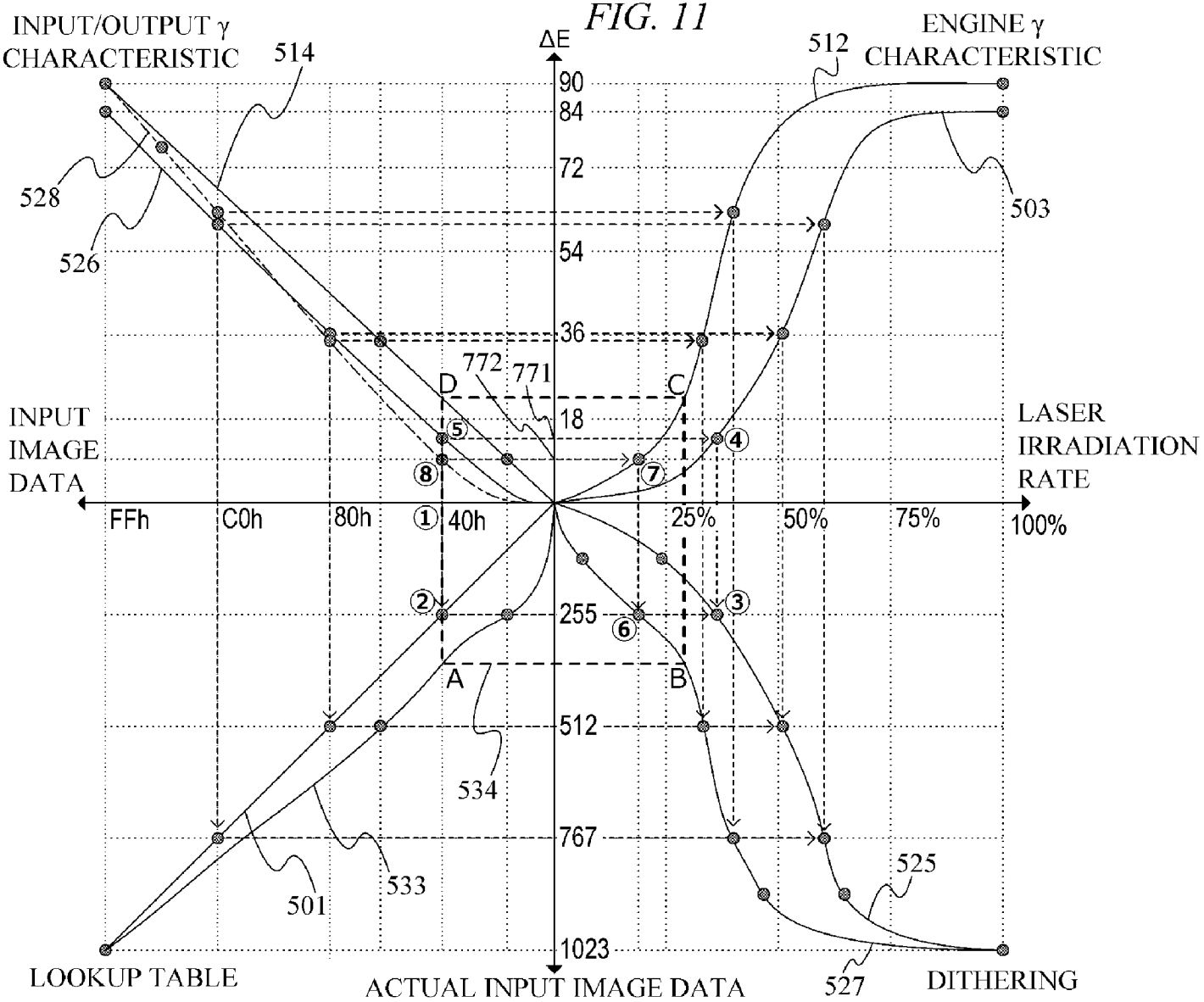
FIG. 11 is a schematic diagram depicting a γ characteristic based on a dithering according to Embodiment 1.

FIG. 11 indicates a γ characteristic in a certain state where the dithering of this embodiment is used. According to this embodiment, as indicated in the fourth quadrant, the exposure conditions for the values of the input image data are changed between the normal print mode and the wide color gamut print mode, hence the dithering 525 in the normal print mode and the dithering 527 in the wide color gamut print mode are different. The reason is that the dither pattern in the normal print mode and the dither pattern in the wide color gamut print mode are different. In concrete terms, in the low gradation region, the dither pattern is used so that ΔE in the wide color gamut print mode is smaller than ΔE in the normal print mode. As described above, in the case of the same laser irradiation rate, ΔE in the wide color gamut print mode is larger than ΔE in the normal print mode. Therefore, in consideration of the engine γ characteristic, the dither pattern is used so that ΔE in the wide color gamut print mode becomes smaller and the laser irradiation rate becomes smaller.

First, it is assumed that an image is formed when the input image data is 40 h in the normal print mode (sign (1)). According to the look-up table 501 without γ correction, the actual input image data is 255 (sign (2)). Then, the actual input image data is converted into the laser irradiation rate by the dithering 525 in the normal print mode (sign (3)). Then, based on ΔE measured by the density detection sensor, the engine γ characteristic 503 in the normal print mode is acquired (sign (4)). Thereby ΔE, when the input image data is 40 h in the normal print mode, can be plotted in the second quadrant (sign (5)). By performing this plotting for the other input image data values as well, the input/output γ characteristic 526 in the normal print mode is acquired. The engine γ characteristic 503 in the normal print mode and the engine γ characteristic 512 in the wide color gamut print mode are the same in FIG. 9. The table to convert the engine γ characteristic 503 in the normal print mode into the engine γ characteristic 512 in the wide color gamut print mode corresponds to the second conversion table to convert ΔE (Normal) into ΔE (wide color gamut).

In the wide color gamut print mode, ΔE is calculated using the table in FIG. 10A and FIG. 10B. Thereby the input/output γ characteristic in the wide color gamut print mode is acquired. For example, when the input image data is 40 h, the same as the normal print mode, the step advances from sign (1) to sign (2), and then the actual input image data is converted into the laser irradiation rate by the dithering 527 in the wide color gamut print mode (signal (6)). ΔE is determined by the engine γ characteristic 512 in the wide color gamut print mode (sign (7)). Thereby in the wide color gamut print mode, ΔE, when the input image data is 40 h, can be plotted in the second quadrant (sign (8)). Then the input/output γ characteristic 528 in the wide color gamut print mode can be acquired.

The engine γ characteristic depends on the state of use, but the dithering 525 in the normal print mode is determined so that the liner input/output γ characteristic, with respect to the input image data, can be acquired to an extent even if this change occurs. As a result, the input/output γ characteristic 526 in the normal print mode has high linearity, which is relatively close to the ideal input/output γ characteristic 506 in the normal print mode indicated in FIG. 9.

In a region in which the input image data is small, the dithering 527 in the wide color gamut print mode must be set so that ΔE (LGT)<ΔE (Normal) is established. In this embodiment, for example, the dithering 527 is set so that ΔE (LGT)<ΔE (Normal) is always established when the value of the input image data is 40 h or less. In concrete terms, in the case of 40 h, ΔE (Normal) 771, which is determined using the dithering 525 and the engine γ characteristic 503 in the normal print mode, is larger than ΔE (LGT) 772, which was determined using the dithering 527 and the engine γ characteristic 512 in the wide color gamut print mode.

533 is a look-up table which was corrected so that the ideal input/output γ characteristic 514 in the wide color gamut print mode is implemented. The broken line 534 indicates each value in the case where the corrected look-up table 533 is used when the input image data is 40 h. In other words, in the case of the wide color gamut print mode, the actual input image data is determined using the corrected look-up table 533 (sign A), the laser irradiation rate is determined using the dithering 527 in the wide color gamut print mode (sign B), ΔE is determined based on the engine γ characteristic 512 in the wide color gamut print mode (sign C), and the ideal input/output γ characteristic 514 in the wide color gamut print mode is determined based on the input image data 40 h and the plot of ΔE (sign D).

To create the corrected look-up table 533, ΔE of the image formed in the wide color gamut print mode may actually be measured, but ΔE in the wide color gamut print mode may be calculated from the measurement result in the normal print mode using the method in FIG. 10A and FIG. 10B. If such a corrected look-up table 533 is created, the γ conversion in the wide color gamut print mode can be performed appropriately.

The input/output γ characteristic 514 in the wide color gamut print mode, the look-up table 501 without γ correction, the dither pattern for the dithering 527 in the wide color gamut print mode, and the dither pattern for the dithering 525 in the normal print mode are assumed to be stored in the memory 2022 in advance. As the dither pattern, a well-known pattern may be used as appropriate, hence detailed description here is omitted. The other characteristic curves change depending on the detection values of the density detection sensor 218 at each detection, and the changed characteristic curves are stored in the memory 2022 until the next density measurement.

Optimum Dithering in Accordance with Engine γ Characteristic

Figure 12:
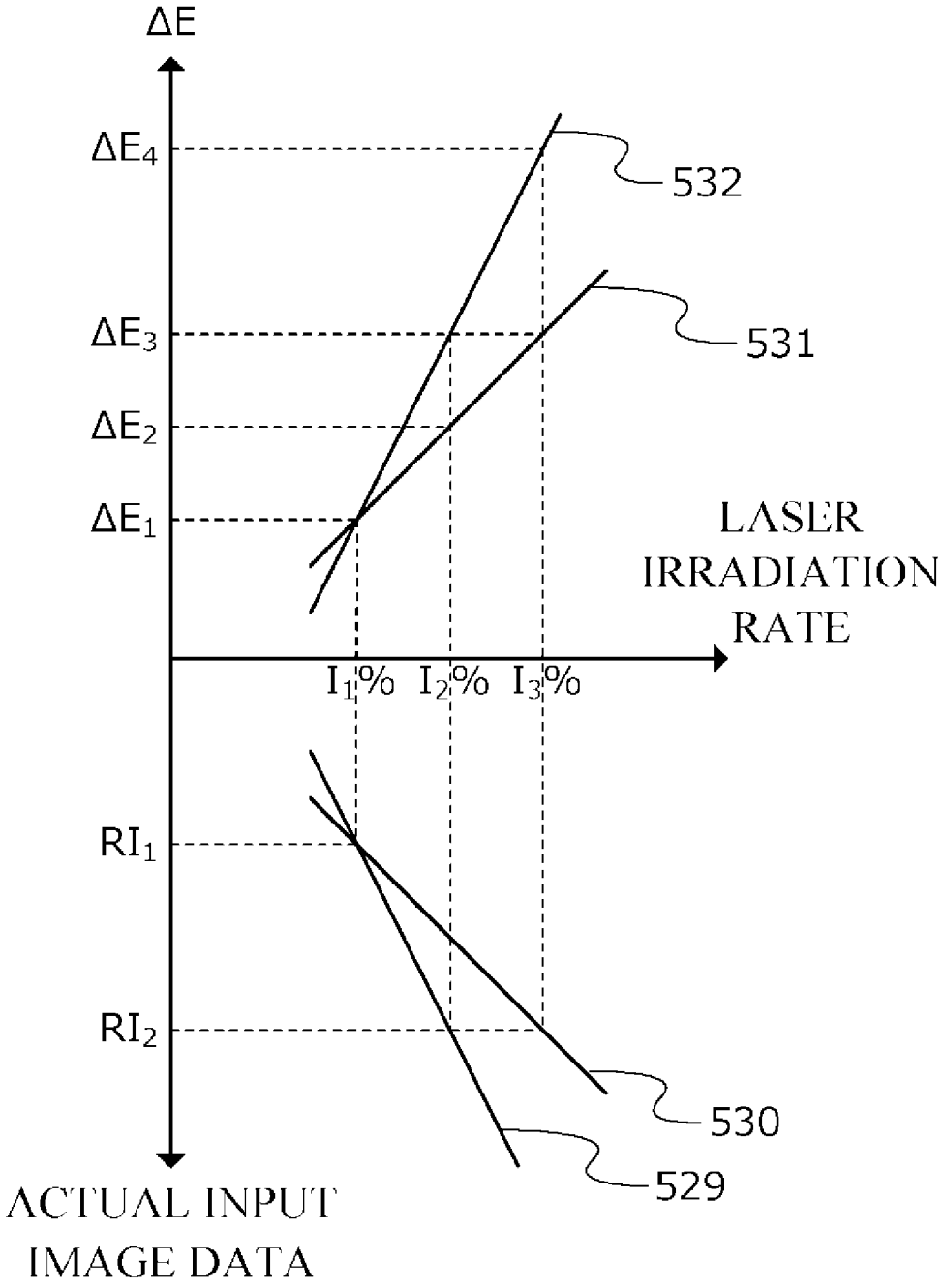
FIG. 12 is a schematic diagram depicting an optimum dithering according to Embodiment 1.

A reason why it is preferable to adjust the dithering in accordance with the engine γ characteristic will be described with reference to FIG. 12. FIG. 12 is a graph of the first quadrant and the fourth quadrant, which are abstracted and extracted from the graph of the input/output characteristic in FIG. 9 or FIG. 11. The first dithering 529 is a dithering of which the chromaticity difference becomes $\Delta E_1$ when the actual input image data is $RI_1$, and becomes $\Delta E_2$ when the actual input image data is $RI_2$, in a first engine γ characteristic 531. The second dithering 530 is a dithering in which chromaticity difference becomes $\Delta E_1$ when the actual input image data is $RI_1$, and becomes $\Delta E_3$ when the actual input image data is $RI_2$, in the first engine γ characteristic 531. Here it is assumed that the chromaticity difference $\Delta E_3$ is larger than the chromaticity difference $\Delta E_2$.

If the actual image data next to $RI_1$ is $RI_2$, the graduation between $\Delta E_1$ and $\Delta E_3$ cannot be expressed using the second dithering 530. With the first dithering 529, on the other hand, $\Delta E_2$, which is an image between $\Delta E_1$ and $\Delta E_3$, can be formed. In other words, compared with the first dithering 529, the change in ΔE with respect to the actual input image data is large and gradation of the image is inferior if the second dithering 530 is used.

Now it is assumed that an image is formed using a specific dithering in accordance with a second engine γ characteristic 532, which is different from the first engine γ characteristic 531. The second engine γ characteristic 532 will be considered in the same manner as the above-mentioned first engine γ characteristic 531. If the first dithering 529 is used, the chromaticity difference becomes $\Delta E_1$ when the actual input image data is $RI_1$, and becomes $\Delta E_3$ when the actual input image data is $RI_2$. If the second dithering 530 is used, the chromaticity difference becomes $\Delta E_1$ when the actual input image data is $RI_1$, and becomes $\Delta E_4$ when the actual input image data is $RI_2$.

Summarizing the above description on the dithering, the degree of change of the laser irradiation rate with respect to the input image data in the case of performing the first dithering 529 is smaller than the degree of change of the laser irradiation rate with respect to the input image data in the case of performing the second dithering 530. In other words, when the ordinate and the abscissa are set as FIG. 12, the inclination of the first dithering 529 is sharper than the inclination of the second dithering 530. As the difference of these inclinations indicates, the gradation of the image is better when the first dithering 529 is performed, compared with performing the second dithering 530.

Summarizing the above description on the engine γ characteristic, the gradation of the image is better when the first engine γ characteristic 531 is used, compared with using the second engine γ characteristic 532 if the same pair of input image data is inputted. This is because the degree of change of ΔE, with respect to the laser irradiation rate when the first engine γ characteristic 531 is used, is smaller than the degree of change of ΔE, with respect to the laser irradiation rate when the second engine γ characteristic 532 is used. In other words, when the ordinate and the abscissa are set as FIG. 12, the inclination of the second engine γ characteristic 532 is sharper than the inclination of the first engine γ characteristic 531.

In order to compensate for the deterioration of the engine γ gradation because of the sharpness of the inclination of the engine γ characteristic (degree of change of ΔE with respect to the laser irradiation rate is large), the gradation is improved by making the inclination of the dithering sharper (decreasing the degree of change of laser irradiation rate with respect to the input image data). On the other hand, in a region where the inclination of the engine γ characteristic is moderate and the engine γ gradation of the image is relatively good, gradation of density can be maintained in general, even if the gradation deteriorates by making the inclination of the dithering moderate.

As a consequence, it is preferable that the inclination of the dithering is sharp in the image data region, which indicates the engine γ characteristic with which gradation of the image deteriorates, and the inclination of the dithering is moderate in the image data region which indicates the engine γ characteristic with which gradation of the image is good. Thereby the gradation of the image can be maintained with good balance with respect to all the image data.

Figure 13:
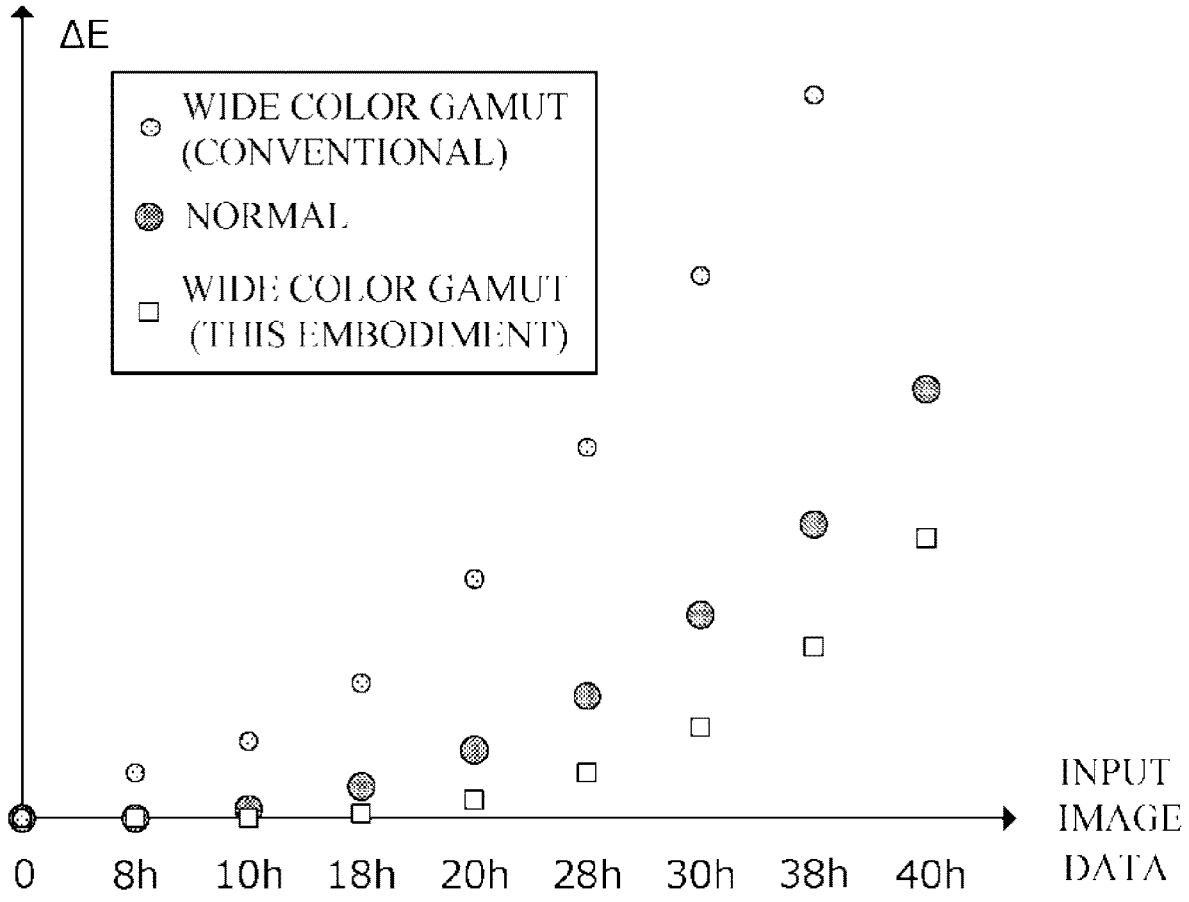
FIG. 13 is a graph depicting a low density region depending on the image forming mode according to Embodiment 1.

The above is the reason why adjusting the dithering in accordance with the engine γ characteristic is desirable. In this embodiment, the dithering 525 for the normal print mode is used in the normal print mode, and the dithering 527 for the wide color gamut print mode is performed in the wide color gamut print mode. The engine γ characteristic, which changes depending on the state, should be designed considering overall balance.

γ Characteristic in Low Density Region in Accordance with Difference of Image Forming Mode FIG. 13 indicates the input/output γ characteristic in the low density region. In the wide color gamut print mode of the comparative example, ΔE may become ΔE=0 in some cases, or may become ΔE≠0 in other cases, in the input image data in which ΔE becomes almost always ΔE=0 in the normal print mode, hence calculating using an approximation line is required. The wide color gamut dithering 527 of this embodiment, on the other hand, is created such that ΔE (LGT)<ΔE (Normal) is always established in the low density region. This means that the calculation using an approximation line is not required. Therefore, a ΔE calculation error depends only on the calculation table in FIG. 10A and FIG. 10B, and errors do not increase exclusively in the low density region.

In this embodiment, the low density region is defined as a region in the 00 h to 20 h range. In some cases, the low density region, where output is not stable, does not strictly depend on the input image data. In other words, ΔE (Normal)=0 may continue for a while even if the input image data is increased, or may change to ΔE (Normal)≠0 relatively quickly. In the case of the configuration of this embodiment, ΔE (Normal)≠0 occurred stably if the density region is at least 20 h, hence the low density region is defined as a region in the 00 h to 20 h range. The value 20 h is a predetermined upper limit value of the low density region, but this upper limit value changes depending on the dithering or the like, and is not always uniquely determined, that is, the upper limit value must be changed in accordance with the engine γ characteristic, dithering and the like. When the input image data is divided into a side of the low density region and a side of the high density region, the "input image data corresponding to the low density region" refers to the input image data on the side where a minimum value is included, or to the input image data on the side including the density of the image to be formed that is small, to be detected by the density detection sensor 218.

An example of the method of determining the input image data corresponding to the low density region will be described. First, the input image data is set to a minimum value (00 h in this example), and then while gradually increasing the value, density detection is repeated using the density detection sensor 218. Thereby, an appropriate "predetermined upper limit value" is determined.

Influence of Chromaticity Error in Comparative Example

Figure 14A:
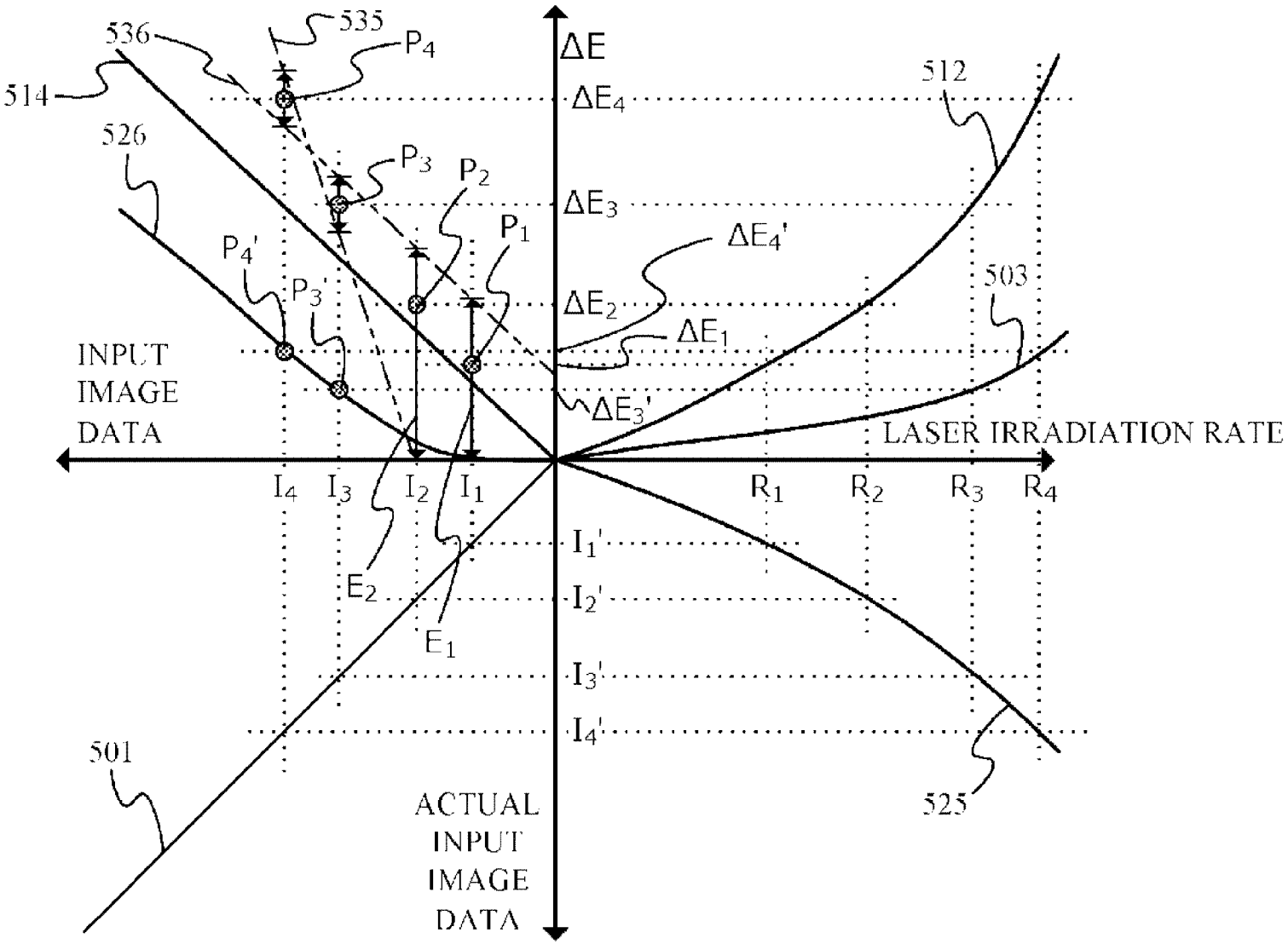
FIG. 14A and FIG. 14B are schematic diagrams depicting the influence of a chromaticity error according to a comparative example.
Figure 14B:
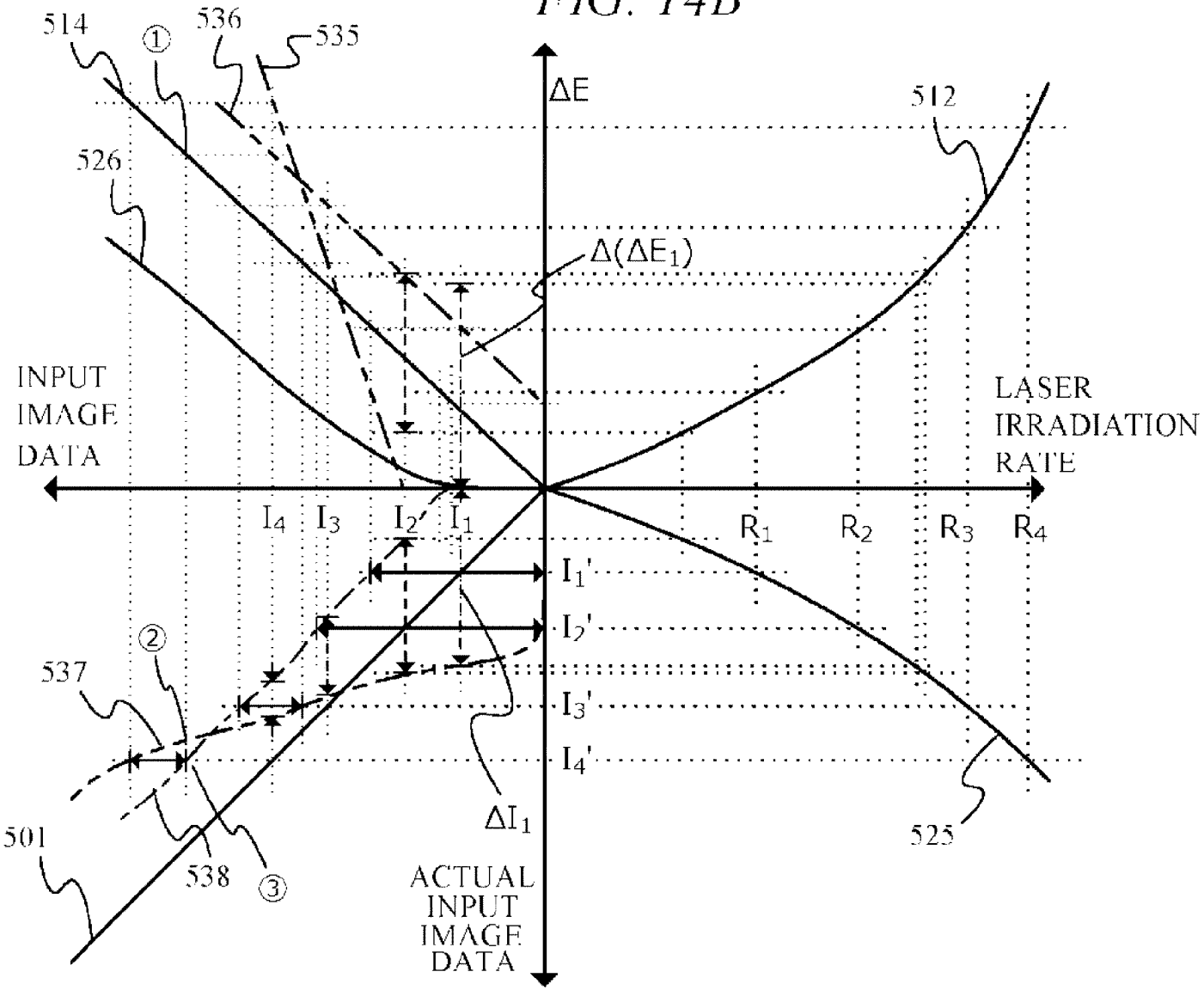

The effect of this embodiment will be described next with reference to FIG. 14A and FIG. 14B and FIG. 15A and FIG. 15B. FIG. 14A and FIG. 14B indicate an error of ΔE (LGT) after the γ correction in the case where the dithering and the calculation method of the comparative example are used. FIG. 14A and FIG. 14B indicate the same state, but are depicted separately in a time series of the calibration sequence to simplify illustration.

The normal print mode of the comparative example will be described first. The input image data $I_3$ and $I_4$ are converted into $I_3'$ and $I_4'$ using the look-up table 501 without γ correction, and are converted into the laser irradiation rates $R_3$ and $R_4$ by the dithering 525. $\Delta E_3'$ and $\Delta E_4'$ are acquired by forming an image in the state of the engine γ characteristic 503 in the normal print mode, and sensing the density by the density detection sensor 218. The result is plotted in the second quadrant, and the input/output γ characteristics $P_3'$ and $P_4'$ in the normal print mode are acquired. Further, other input image data are plotted, and the input/output γ characteristic 526 in the normal print mode are acquired.

A correction method from the normal print mode to the wide color gamut print mode according to the comparative example will be described next. As described above, from the measured chromaticity differences $\Delta E_3'$ and $\Delta E_4'$ in the normal print mode, $\Delta E_3$ and $\Delta E_4$ in the color gamut print mode are calculated. Here a calculation error is generated. For example, in the case of the input image data $I_3$ or $I_4$ of which values are relatively large, the calculation error is relatively small, as indicated in $P_3$ and $P_4$. However, if a value in the low density region (region near $I_1$ and $I_2$, where the value of the input image data is relatively small) is determined by extrapolation, the influence of this calculation error increases, and a large calculation error, such as $P_1$ or $P_2$, is generated. Because of this calculation error, the inclination of the extrapolated line can change in the range between the extrapolated line 535 and the extrapolated line 536. The errors in the input image data $I_1$ and $I_2$ are determined by the extrapolated line 535 and the extrapolated line 536, and become $E_1$ and $E_2$ expressed by the arrow length in FIG. 14A.

FIG. 14B indicates the error in the look-up table and the output error generated thereby. An ideal input image data is calculated by comparing each of the upper limit value and the lower limit value in the variation ranges of the points $P_1$, $P_2$, $P_3$ and $P_4$ indicated in FIG. 14A, with the input/output γ characteristic 514 in the ideal wide color gamut print mode. From these values of the ideal input image data, the look-up table 537 and the look-up table 538 are calculated.

In other words, the upper limit value and the lower limit value of each error range of $P_1$ to $P_4$ are compared with the ideal wide color gamut input/output γ characteristic (input/output γ characteristic) 514. For example, it is assumed that the upper limit value of $\Delta E_4$, when the input image data is $I_4$, is $\Delta E_4$ (max), and the lower limit value thereof is $\Delta E_4$ (min). This corresponds to the values of the upward and downward arrows of $P_4$ in the second quadrant in FIG. 14A. In the case where the error is the upper limit value, if the look-up table 501 without γ correction is used, the chromaticity difference becomes $\Delta E_4$ (max) when the input image data is $I_4$. Therefore, in order to make the chromaticity difference when the input image data is $I_4$ become a point on the ideal input/output γ characteristic 514 in the wide color gamut print mode (sign (1)), the conversion into the actual input image data is performed using the point on the look-up table 537 (sign (2)).

In the case where the error is the lower limit value, if the look-up table 501 without γ correction is used, the chromaticity difference becomes $\Delta E_4$ (min) when the input image data is $I_4$. Therefore, in order to make the chromaticity difference when the input image data is $I_4$ become a point on the ideal input/output γ characteristic 514 in the wide color gamut print mode (sign (1)), the conversion into actual input image data is performed using the point on the look-up table 538 (sign (3)).

The region between the look-up table 537 and the look-up table 538 determined like this is an error of the look-up table. For example, in the case of the input image data I1, the range of the input image data is ΔI1 indicated by the arrow in FIG. 14B. This error of the input image data generates the variation Δ(ΔE1) of ΔE. For other image data as well, the variation of ΔE is calculated. Thus, in the comparative example, the profile of the look-up table in the γ correction is largely influenced by the chromaticity error.

Influence of Chromaticity Error in Embodiment 1

Figure 15A:
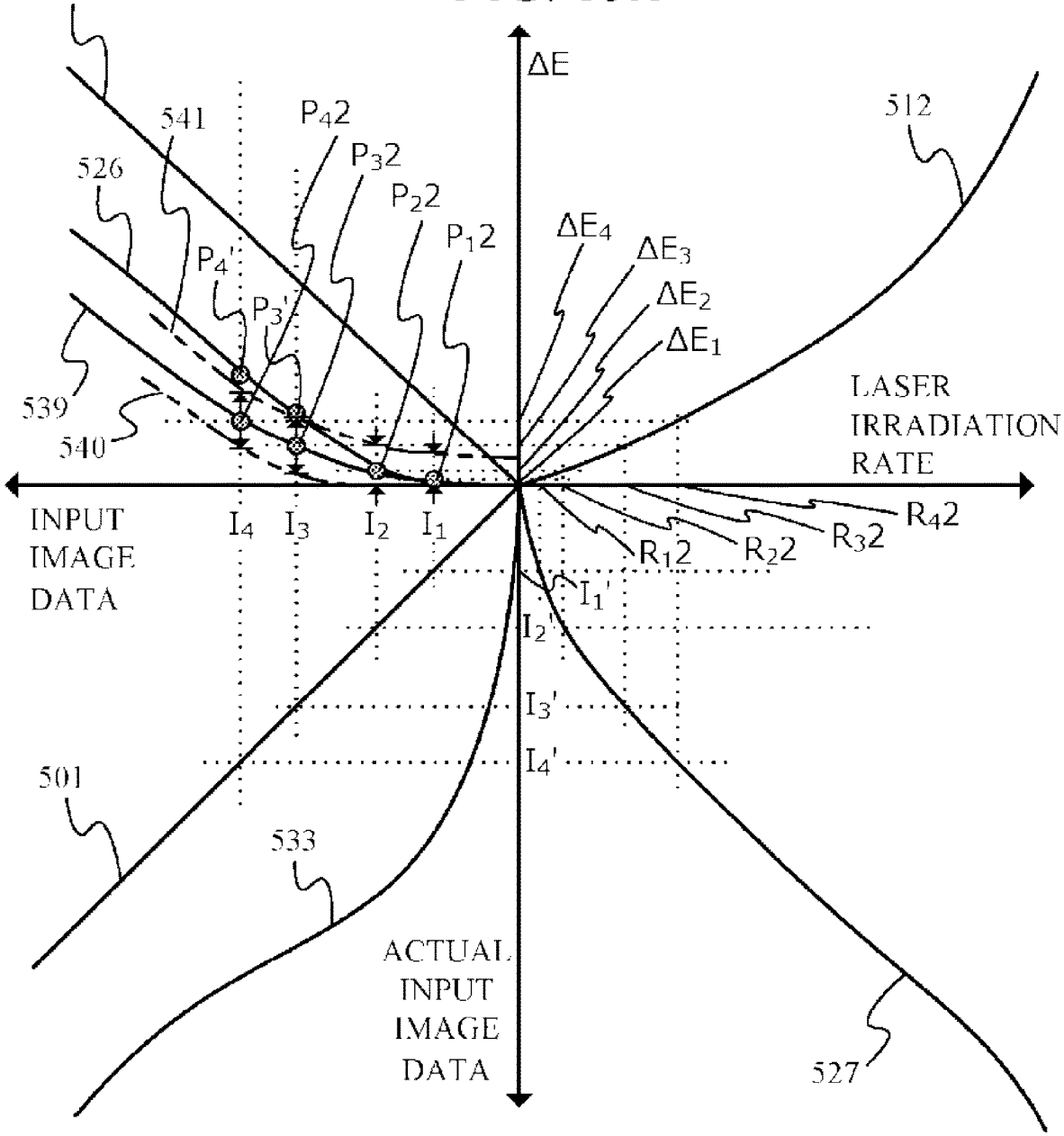
FIG. 15A and FIG. 15B are schematic diagrams depicting the influence of a chromaticity error according to Embodiment 1.
Figure 15B:
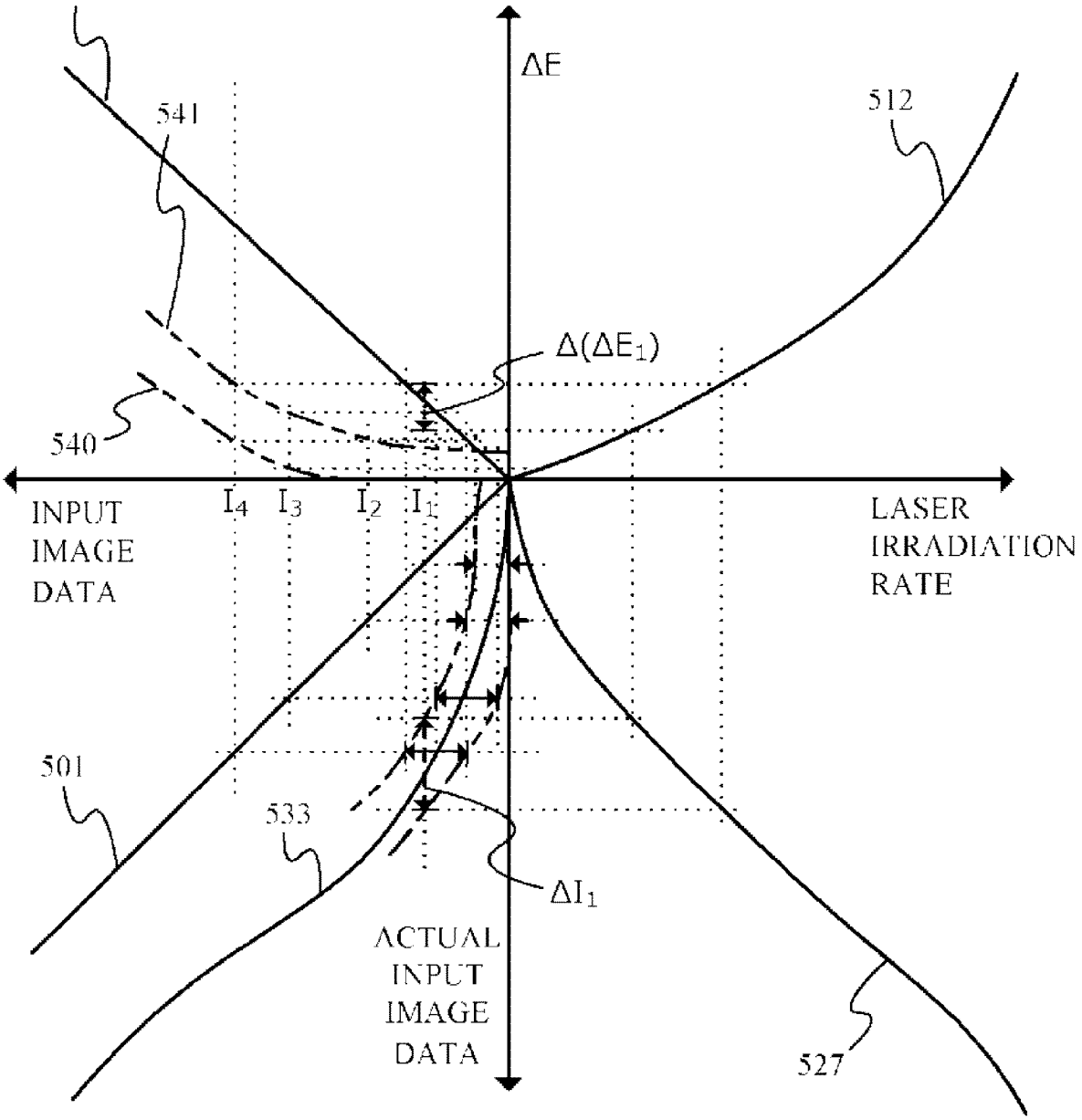

An error of ΔE (LGT) after γ correction in the case of using the dithering and the calculation method according to this embodiment will be described next with reference to FIG. 15A and FIG. 15B. First, ΔE in the normal print mode is calculated when the input image data is I1, 12, 13 and respectively, just like FIG. 14A and FIG. 14B. Then ΔE in the wide color gamut print mode is calculated by the above-mentioned correction method. The calculation result determined here is the result determined performing the dithering 527 for the wide color gamut print mode in the wide color gamut print mode. According to the dithering 527 in the wide color gamut print mode, the actual input image data I1', I2', I3' and I4', which were converted from the input image data I1, I2, I3 and I4, are converted into the laser irradiation rates R12, R22, R32 and R42, respectively. Then in the state of the engine γ characteristic 512 in the wide color gamut print mode, P12, P22, P32 and P42 are plotted in the second quadrant, whereby the input/output γ characteristic 539 in the wide color gamut print mode is calculated.

At this time, for the dithering, the dithering 527 for the wide color gamut print mode, which is determined in accordance with the engine γ characteristic 512 in the wide color gamut print mode, is used. As a result, an error at each point is smaller than the comparative example, and is approximately constant, which is between the first input/output γ characteristic 540 and the second input/output γ characteristic 541. Hereafter an error of the look-up table and the output error generated thereby are calculated in the same manner as the case of FIG. 14A and FIG. 14B. Then ΔI1 and Δ(ΔE1), indicated in FIG. 15B, are determined. In this embodiment, as indicated in FIG. 15B, an error, generated when ΔE is calculated in the wide color gamut print mode, becomes smaller in the low density region, hence the error of the lookup table also decreases, and the output error after γ correction also decreases accordingly.

Flow Chart of γ Correction by Image Forming Apparatus

Figure 19:
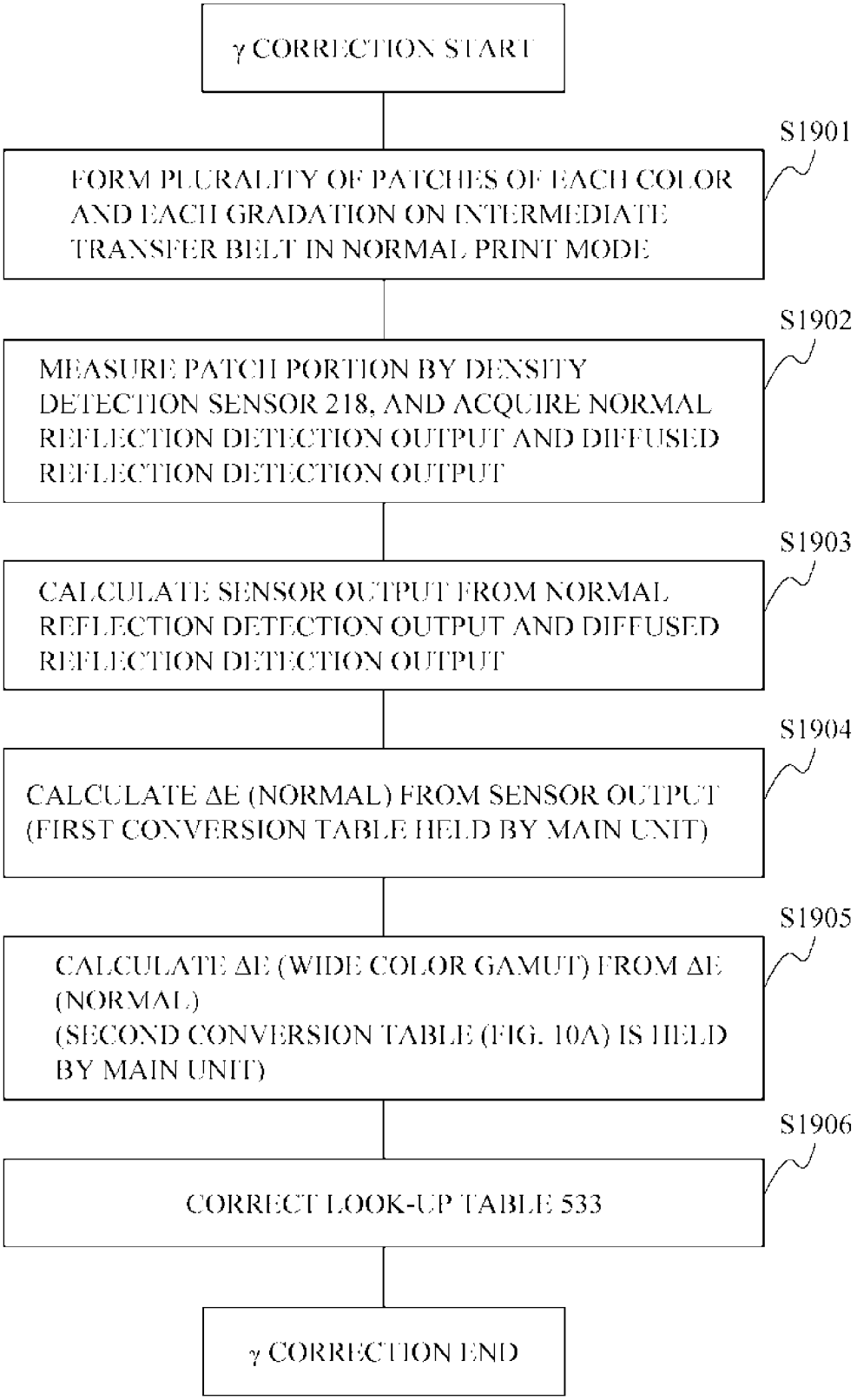
FIG. 19 is a flow chart depicting γ correction by the image forming apparatus according to Embodiment 1.
Figure 20:
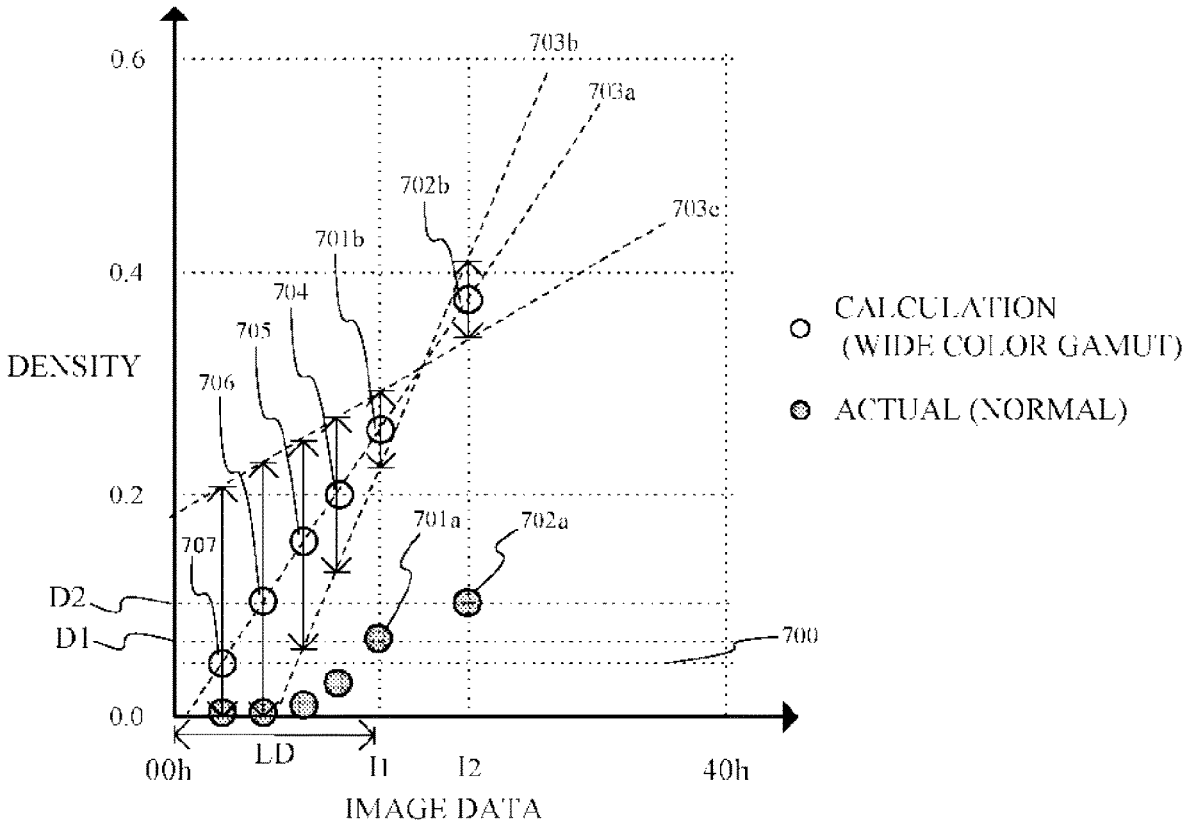
FIG. 20 is a schematic diagram depicting calculation of chromaticity in a low density portion according to a comparative example.

The processing related to the γ correction by the image forming apparatus 200 will be described with reference to the flow chart in FIG. 19. First in S1901, the CPU 2021 operates the units related to the toner image formation in the normal print mode. Specifically, based on the instructions from the CPU 2021, the process cartridge 204 forms a plurality of patches on the intermediate transfer belt 205, to detect the density using the density detection sensor 218 (FIG. 6). The plurality of patches includes patches from light density to dark density, and the gradation of each patch is different. The patch of each gradation is formed for each color of YMCK.

In the γ correction for the normal print mode which is started from S1901, the image forming apparatus 200 uses the look-up table 501 and forms patches. The γ correction is not performed to the look-up table 501. Alternatively, the image forming apparatus 200 may use the corrected look-up table when the image forming apparatus 200 forms toner patches on the intermediate transfer belt 205 for the γ correction for the normal print mode.

Then in S1902, the density detection sensor 218 detects the density of each patch formed on the intermediate transfer belt 205. As described with reference to FIG. 6 and FIG. 7, a measured density value becomes a value in accordance with the normal reflection light and the diffused reflection light from the patches.

In S1903, the measured value of the reflected light is acquired by the CPU 2021. The density value acquired by the CPU 2021 may be a value determined by subtracting a diffused reflection detection output 402 from a normal reflection detection output 401, or a value determined by further converting this value into a density value. A density value determined by eliminating the influence of the base of the intermediate transfer belt 205 on which the patches are formed may be used.

Then in S1904, the CPU 2021 inputs the density value of each gradation, computed in S1903, to a first conversion table which is stored in the memory 2022 in advance, and acquires the converted value (ΔE (Normal)) of the density value of each gradation. The conversion table is provided for each color, and the output value from the first conversion table is ΔE (Normal) for each color.

In S1905, the CPU 2021 inputs ΔE (Normal) for each color and for each gradation acquired in S1904, to a second conversion table, which is also stored in the memory 2022 for each color in advance, and acquires the output value ΔE (wide color gamut) from the second conversion table described in FIG. 10. The output value ΔE for wide color gamut mode output from the second conversion table corresponds to ΔE for wide color gamut mode shown in FIG. 13 with rectangle dot (WIDE COLOR GAMUT (THIS EMBODIMENT)). The relationship between ΔE indicated by [WIDE COLOR GAMUT (THIS EMBODIMENT)] in FIG. 13 and ΔE indicated by [Normal] in FIG. 13 will be explained in detail with FIG. 11. The CPU 2021 obtains the actual image data 255 (sign (2)) by using the look-up table 501 to which the γ correction is not performed when the input image data 40 h (sign (1)) is input in the normal print mode. Next, the CPU 2021 performs the dithering process 525 for the normal print mode which exchange the actual input data to the laser irradiation rate (sign (3)). Next, the CPU 2021 obtains the engine γ characteristic 503 (sign (4)) in the normal print mode based on ΔE calculated by the signal detected by the density detection sensor 218. Thereby ΔE, when the input image data is 40 h in the normal print mode, can be plotted in the second quadrant (sign (5)). The value of ΔE indicated by sign (5) is equal to the value of ΔE calculated based on the detection result of the toner patches detected by the density detection sensor 218 in the normal print mode.

Also, the CPU 2021 obtains the actual image data 255 (sign (2)) by using the look-up table 501 to which the γ correction is not performed when the input image data 40 h (sign (1)) is input in the wide color gamut print mode. Next, the CPU 2021 performs the dithering process 527 for the wide color gamut print mode which exchange the actual input data to the laser irradiation rate (sign (6)). The ΔE is determined by the γ characteristic 512 in the wide color gamut print mode (sign (7)). Thereby ΔE, when the input image data is 40 h in the wide color gamut print mode, can be plotted in the second quadrant (sign (8)). Also, the CPU 2021 calculates each ΔE (sign (5)) for the each gradation value such as 20 h for the normal print mode and each ΔE (sign (8)) for the each gradation value for the wide color gamut print mode. Then, the CPU 2021 generates the second conversion table based on the relationship between (i) the ΔE for the normal print mode and (ii) the ΔE for the wide color gamut print mode.

The ΔE indicated by (sign (8)) calculated for the wide color gamut print mode correspond to the ΔE (wide color gamut) converted in S1905. Here, in at least a part of the input image data in which the density of an image to be formed is on a low density region side, the ΔE indicated by (sign (8)) is smaller than the ΔE indicated by (sign (5)).

Finally in S1906, the CPU 2021 corrects the look-up table 533 based on ΔE (wide color gamut) for each color and for each gradation acquired in S1905, stores the corrected look-up table 533 in the memory 2022, and uses the corrected look-up table 553 for the subsequent execution in the wide color gamut print mode. The computing of the look-up table 533 by the CPU 2021 is as described above, mainly with reference to FIG. 11, hence detailed description here is omitted.

Also, as long as the ΔE in the wide color gamut print mode calculated for the input data on a low density region side is smaller than the ΔE in the normal print mode calculated for the same input data (the same value), any combinations of (i) the dither pattern for the wide color gamut mode and (ii) the look-up table to which the γ correction is performed may be applied for the wide color gamut mode.

As described above, according to the image forming apparatus of this embodiment, when the tinge in the image forming mode, to implement another color gamut, is calculated from a tinge in the standard image forming mode, errors do not increase even in the calculation of the tinge in the low density region. In the configuration of this embodiment, the control target is the chromaticity difference from the non-image forming portion, but the control target is not limited to the chromaticity difference, and may be density, for example. Further, in the configuration of this embodiment, the peripheral velocity ratio of the developing roller 303 is used to implement the wide color gamut print mode, but this is not limited to the peripheral velocity ratio, and may be another parameter to control the toner supply amount.

Embodiment 2

A difference of Embodiment 2 from Embodiment 1 is in the modes in which the image forming apparatus operates. Embodiment will be described using an example of having a normal print mode (first mode) and a toner saving print mode (second mode) to save toner consumption will be described. In other words, in Embodiment 2, a standard image forming mode is the normal mode, and a density-variable image forming mode is the toner saving mode. The configuration of the image forming apparatus, however, is the same as Embodiment 1, including having the first conversion table to convert the detection value (density value), detected by the density detection sensor 218, into ΔE (Normal), hence the description thereof is omitted.

Surface Potential of Photosensitive Drum

Figure 16:
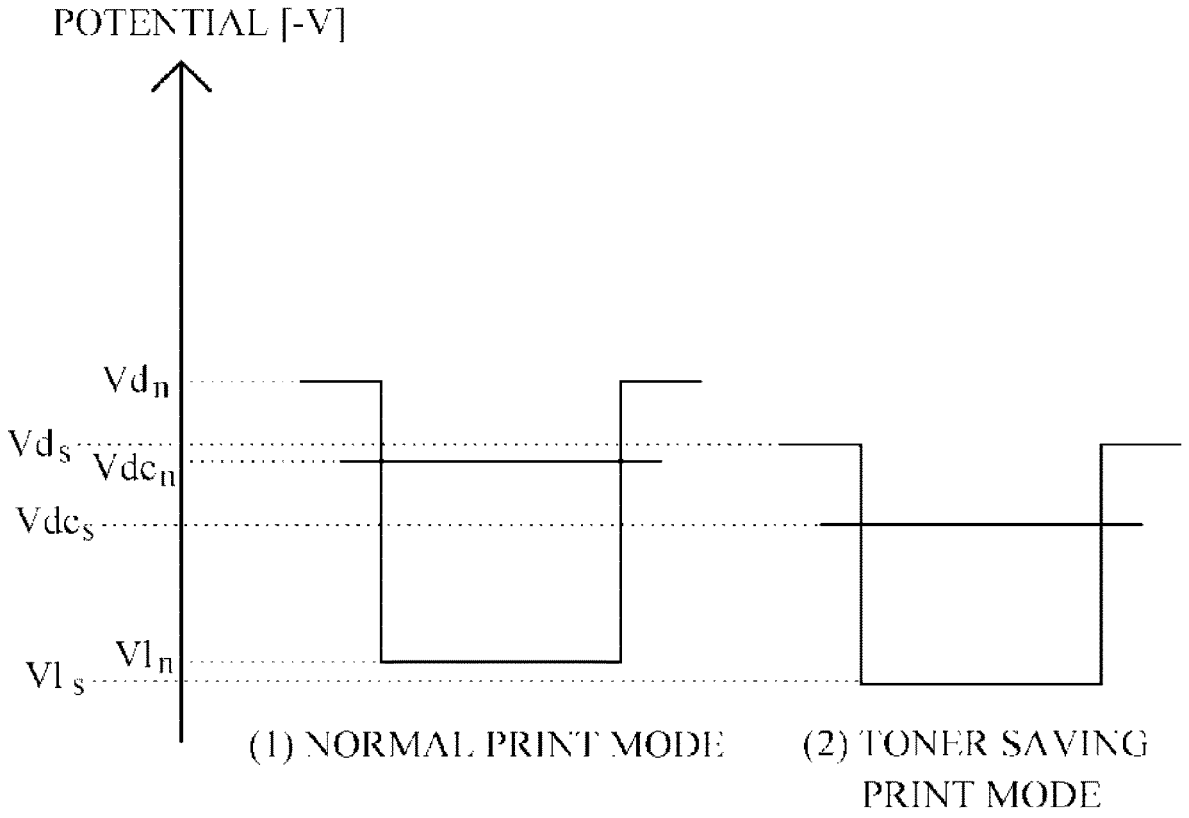
FIG. 16 is a schematic diagram depicting a surface potential of a photosensitive drum according to Embodiment 2.

The surface potential of the photosensitive drum 301 in the normal print mode and the toner saving print mode will be described with reference to FIG. 16. In the toner saving print mode, the peripheral velocity ratio is decreased by decreasing the peripheral velocity of the developing roller 303, and toner consumption is suppressed by decreasing the toner amount per unit area on the photosensitive drum 301. Further, along with the change of the peripheral velocity ratio, the surface potential of the photosensitive drum 301 is optimized, just like in Embodiment 1. In terms of the developing efficiency, there are no problems if the potential contrast Vcont is the same as that in the normal print mode; however, reducing the discharge amount has an advantage, such as the abrasion of the charge transport layer 314 can be suppressed.

Therefore, in the normal print mode according to the configuration of Embodiment 2, the peripheral velocity ratio 1.4, Vdn=−500V, Vdcn=−350V and Vln=−100V are used. In the toner saving print mode, the peripheral velocity ratio 1.1, Vds=−380V, Vdcs=−250V and Vlns=−50V are used. Here the charging bias Vd, development potential Vdc and exposure potential Vl are denoted by Vds, Vdcs and Vls, respectively.

γ Characteristic Based on Dithering of Embodiment 2

Figure 17:
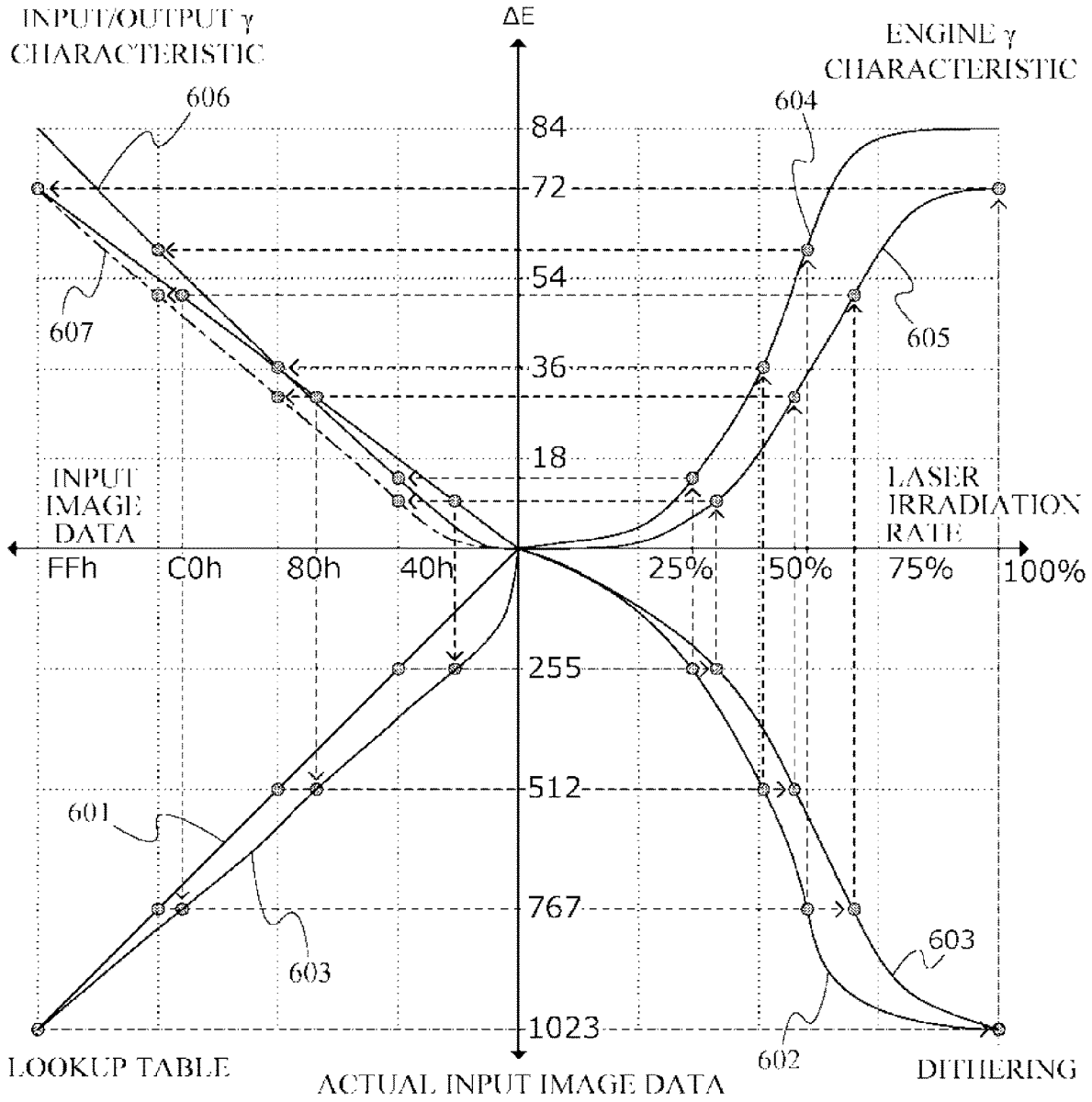
FIG. 17 is a schematic diagram depicting a γ characteristic based on a dithering according to Embodiment 2.

FIG. 17 indicates the γ characteristics in the normal print mode and the toner saving print mode. The calibration sequence is the same as Embodiment 1. Just like Embodiment 1, the engine γ characteristic 604 in the normal print mode and the engine γ characteristic 605 in the toner saving print mode are acquired using the look-up table 601 without γ correction, the dithering 602 in the normal print mode and the dithering 603 in the toner saving print mode. The table, to convert the engine γ characteristic 604 into the engine γ characteristic 605, corresponds to the second conversion table.

When the input/output γ characteristic 606 in the normal print mode and the input/output γ characteristic 607 in the toner saving print mode are compared in the low density region, ΔE in the toner saving print mode is smaller than ΔE in the normal print mode. Therefore, it is not necessary to calculate the engine γ characteristic 605 in the high density region to determine the engine γ characteristic 605 in the high density region. As a result, the variation of the engine γ characteristic 605 in the low density region can be minimized.

As described above, according to the image forming apparatus of Embodiment 2, which has a configuration to calculate the tinge in the toner saving image forming mode based on the tinge in the standard image forming mode, errors do not increase even in the calculation of the tinge in the low density region.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

As described above, according to the above disclosure, the error in the tinge of an image can be decreased without increasing the downtime, in a configuration where an image can be formed in the image forming mode, in which the color gamut is different from the standard image forming mode.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-9779, filed on Jan. 23, 2019, which is hereby incorporated by reference herein in its entirety.

What is claimed is:

1. An image forming apparatus configured to operate in a first mode in which an image is formed in a first color gamut, and a second mode in which an image is formed in a second color gamut which is different from the first color gamut, the image forming apparatus comprising:

a photosensitive drum;

an exposure unit configured to form an electrostatic latent image by exposing the photosensitive drum;

a developing roller configured to form a toner image by developing the electrostatic latent image which is formed using a toner on the photosensitive drum by the exposure unit;

an intermediate transfer member to which the toner image formed on the photosensitive drum by the developing roller is transferred;

a density detection unit configured to detect the density of the toner image transferred to the intermediate transfer member; and a controller configured to adjust the density of the toner image on the basis of a value of input image data which is inputted, wherein the image forming apparatus is operable so as to control a peripheral velocity ratio between a peripheral velocity of the developing roller and a peripheral velocity of the photosensitive drum in the second mode to be greater than the peripheral velocity ratio in the first mode, and in at least a part of the input image data in which the density of an image to be formed is on a low density region side, the density of the toner image which is formed in the first mode is higher than the density of the toner image which is formed in the second mode.

2. The image forming apparatus according to claim 1, wherein the at least a part of the input image data is input image data, with which the density of an image formed using at least a part of the input image data detected by the density detection unit is stable and does not increase in accordance with an increase of the value of the input image data.

3. The image forming apparatus according to claim 2, wherein the at least a part of the input image data is input image data which has a value smaller than a predetermined upper limit value among the input image data.

4. The image forming apparatus according to claim 1, wherein the controller calculates the density in the second mode, using a predetermined table, from the density acquired by the density detection unit detecting the image formed in the first mode.

5. The image forming apparatus according to claim 4, wherein the predetermined table is a table that records a value to add to the density of an image formed in the first mode in accordance with a degree of use of the photosensitive drum and the developing roller.

6. The image forming apparatus according to claim 1, wherein the controller changes the supply amount of the toner between the first mode and the second mode by controlling the peripheral velocity ratio.

7. The image forming apparatus according to claim 1, wherein the second mode is a wide color gamut print mode of which color gamut is wider than the color gamut in the first mode.

* * * * *